US010416600B2

(12) United States Patent
Shibuya

(10) Patent No.: US 10,416,600 B2
(45) Date of Patent: Sep. 17, 2019

(54) IMAGE FORMING APPARATUS, NON-TRANSITORY COMPUTER-READABLE RECORDING MEDIUM HAVING PROGRAM STORED THEREON, AND SERVER

(71) Applicant: Konica Minolta, Inc., Tokyo (JP)

(72) Inventor: Satoru Shibuya, Chiryu (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/174,794

(22) Filed: Oct. 30, 2018

(65) Prior Publication Data

US 2019/0137920 A1 May 9, 2019

(30) Foreign Application Priority Data

Nov. 8, 2017 (JP) ..... 2017-215718

(51) Int. Cl.
*G03G 15/00* (2006.01)
*G03G 15/02* (2006.01)
*G03G 15/16* (2006.01)

(52) U.S. Cl.
CPC ..... *G03G 15/5037* (2013.01); *G03G 15/80* (2013.01)

(58) Field of Classification Search
CPC ..... G03G 15/0258; G03G 15/1675; G03G 15/553
USPC ..... 399/24, 31, 34, 66
See application file for complete search history.

(56) References Cited

U.S. PATENT DOCUMENTS 7,305,193 B2 * 12/2007 Nishimura ..... G03G 15/1675 399/31

FOREIGN PATENT DOCUMENTS

JP 2004-184601 A 7/2004
JP 2006-003538 A 1/2006

* cited by examiner

*Primary Examiner* — William J Royer
(74) *Attorney, Agent, or Firm* — Lucas & Mercanti, LLP

(57) ABSTRACT

An image forming apparatus includes a member arranged in contact with or in proximity to an image carrier, a sensor for measuring an electrical characteristic value of the member, a power supply which switches from a first mode in which one of a constant current and a constant voltage is applied to the member to a second mode in which the other is applied to the member, a storage which stores first correspondence between an amount of use of the member in the first mode and the electrical characteristic value, and a hardware processor. The hardware processor obtains second correspondence between the electrical characteristic value measured with the sensor and the amount of use of the member in the first mode and predicts a serviceable period of the member when the power supply is switched to the second mode based on the first and the second correspondences.

19 Claims, 20 Drawing Sheets

841

| THE CUMULATIVE NUMBER OF SHEETS [k SHEETS] | 0～100 | 101～200 | 201～300 | 301～400 | 401～500 | 501～600 | 601～700 | 701～800 | 801～ |
|---|---|---|---|---|---|---|---|---|---|
| RATE OF VARIATION [log Ω/100 k SHEETS] | 0.16 | 0.12 | 0.08 | 0.06 | 0.04 | 0.02 | 0.01 | 0.005 | 0.003 |

FIG.14

845

| AVERAGE NUMBER OF PRINTED SHEETS PER PRINT JOB | CORRECTION COEFFICIENT |
|---|---|
| 15.1～ | 0.8 |
| 10.1～15.0 | 0.9 |
| 5.1～10 | 1 |
| 3.1～5.0 | 1.2 |
| 1.0～3.0 | 1.4 |

FIG.15

847

| AVERAGE ENVIRONMENT | CORRECTION COEFFICIENT |
|---|---|
| HH | 1.3 |
| NN～HH | 1.15 |
| NN | 1 |
| NN～LL | 0.85 |
| LL | 0.7 |

1710

| THE CUMULATIVE NUMBER OF SHEETS [k SHEETS] | 0～100 | 101～200 | 201～300 | 301～400 | 401～500 | 501～600 | 601～700 | 701～800 | 801～ |
|---|---|---|---|---|---|---|---|---|---|
| RATE OF VARIATION [log Ω/100 k SHEETS] | 0.1 | 0.1 | 0.1 | 0.1 | 0.1 | 0.1 | 0.1 | 0.1 | 0.1 |

IMAGE FORMING APPARATUS, NON-TRANSITORY COMPUTER-READABLE RECORDING MEDIUM HAVING PROGRAM STORED THEREON, AND SERVER

The entire disclosure of Japanese Patent Application No. 2017-215718 filed on Nov. 8, 2017 is incorporated herein by reference in its entirety.

BACKGROUND

Technological Field

This disclosure relates to an image forming apparatus and more particularly to a technique to predict a serviceable period of a member included in an image forming apparatus.

Description of the Related Art

An electrical appliance has recently been demanded to be longer in lifetime in consideration of environmental friendliness. This is also the case with an image forming apparatus. In order to achieve a long lifetime of the image forming apparatus, for example. Japanese Laid-Open Patent Publication No. 2004-184601 discloses an image forming apparatus "including a sensor which compares an actually measured resistance value of a transfer roller found from a transfer current value and a transfer voltage value with a reference resistance value and determines that a lifetime of the transfer roller has expired when the actually measured resistance value is higher than the reference resistance value" (see "Abstract").

Japanese Laid-Open Patent Publication No. 2006-003538 discloses such a configuration that "when it is determined that a resistance value of the transfer roller does not exceed a reference limiting value, an operation mode of the printing operation is set to a first printing mode . . . when it is determined that a resistance value of the transfer roller exceeds a reference limiting value, the operation mode of the printing operation is set to a second printing mode" (see Abstract").

SUMMARY

An image forming apparatus is required to have not only a long lifetime but also a configuration for accurately predicting a lifetime of a member. By accurately predicting a lifetime of a member, a user of the image forming apparatus can prepare a backup supply of the member in advance or a serviceperson can timely visit the user for replacement of the member.

The image forming apparatus disclosed in Japanese Laid-Open Patent Publication No. 2004-184601 is configured to determine a lifetime of a member based on a resistance value of the transfer roller. The image forming apparatus disclosed in Japanese Laid-Open Patent Publication No. 2006-003538 switches from the first printing mode in which a constant voltage is applied to the transfer roller to the second printing mode in which a constant current is fed to the transfer roller. According to the configuration, the resistance value of the transfer roller non-linearly varies in the first mode whereas it linearly varies in the second mode.

In an example in which a behavior of an electrical characteristic value (for example, a resistance value) of a member is different depending on a mode as above, when a lifetime of the transfer roller is predicted simply based on transition of the electrical characteristic value of the transfer roller in the first mode, a result of prediction may greatly deviate from the actual lifetime. Therefore, an image forming apparatus in which a behavior of transition of an electrical characteristic value of a member is different depending on a mode requires a technique to accurately estimate a lifetime of the member.

The present disclosure was made to solve the problems as above, and an object in one aspect is to provide a technique to accurately predict a lifetime of a member included in an image forming apparatus.

To achieve at least one of the abovementioned objects, according to an aspect of the present invention, an image forming apparatus reflecting one aspect of the present invention comprises an image carrier for carrying a toner image, a member arranged in contact with or in proximity to the image carrier, a sensor for measuring an electrical characteristic value of the member, a power supply configured to be able to switch from a first mode in which one of a constant current and a constant voltage is applied to the member to a second mode in which the other of the constant current and the constant voltage is applied to the member as the member is used, a storage which stores first correspondence between an amount of use of the member in the first mode and the electrical characteristic value, and a hardware processor configured to predict a serviceable period of the member. The hardware processor is configured to obtain second correspondence between the electrical characteristic value measured with the sensor and the amount of use of the member in the first mode and to predict a serviceable period of the member when the power supply is switched to the second mode based on the first correspondence and the second correspondence.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

FIG. 14 is a diagram showing one example of a data structure in a number-of-sheets correction table.

FIG. 15 is a diagram showing one example of a data structure in an environment correction table.

DETAILED DESCRIPTION OF EMBODIMENTS

Figure 1:
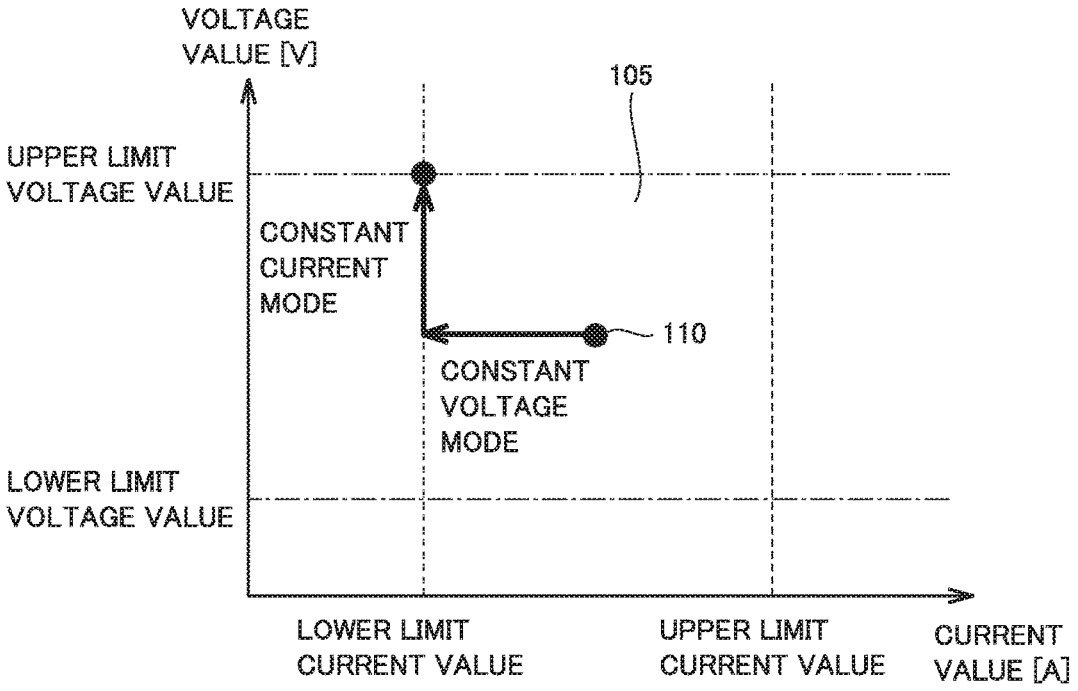
FIG. 1 is a diagram showing switching from a constant voltage mode in which a constant voltage is applied to a member to a constant current mode in which a constant current is fed to the member.

Hereinafter, one or more embodiments of the present invention will be described with reference to the drawings. However, the scope of the invention is not limited to the disclosed embodiments.

An embodiment of this technical concept will be described below in detail with reference to the drawings. In the description below, the same components have the same reference characters allotted and their labels and functions are also the same. Therefore, detailed description thereof will not be repeated. Each embodiment and each modification described below may selectively be combined as appropriate.

[Introduction]

An electrophotographic image forming apparatus includes an image carrier (for example, a photoconductor and an intermediate transfer element) which carries a toner image and a member arranged in contact with or in proximity to the image carrier (for example, a charging roller, a primary transfer roller, and a secondary transfer roller). The image forming apparatus charges a member by applying a voltage to the member.

The image forming apparatus according to the related art switches a method of supply of electric power to a member arranged in contact with or in proximity to an image carrier based on an electrical characteristic value (for example, a resistance value, a voltage value, and a current value) of the member.

FIG. 1 shows switching from a constant voltage mode in which a constant voltage is applied to a member to a constant current mode in which a constant current is fed to the member. The abscissa in FIG. 1 represents a value of a current fed to the member and the ordinate represents a value of a voltage applied to the member.

The image forming apparatus controls a voltage and a current to be applied to the member within a region 105 (a region surrounded by a dashed line and a chain dotted line), because some kind of defective image is produced when a voltage value or a current value is outside region 105. An example in which a primary transfer roller is defined as the member will be described. When a value of a voltage or a current to be applied to the primary transfer roller is equal to or smaller than a lower limit value, a toner image formed on a photoconductor cannot sufficiently be transferred to an intermediate transfer element. Alternatively, when a value of a voltage or a current to be applied to the primary transfer roller is equal to or greater than an upper limit value, discharging occurs between the primary transfer roller and the photoconductor and noise like spots is produced in a toner image.

An initial value 110 represents an initial value of a voltage and a current applied to the member. By way of example, initial value 110 is set at the center in region 105.

In the example shown in FIG. 1, the image forming apparatus initially applies a constant voltage to the member. When a voltage is applied to the member, a resistance value of the member gradually increases. Therefore, a value of the current which flows to the member gradually becomes smaller. The image forming apparatus applies a constant current to the member when a value of the current which flows to the member reaches the lower limit value. In this case, a value of the voltage generated in the member gradually increases with increase in resistance value of the member. The image forming apparatus determines that the lifetime of the member has expired when the value of the voltage generated in the member reaches the upper limit value.

Figure 2:
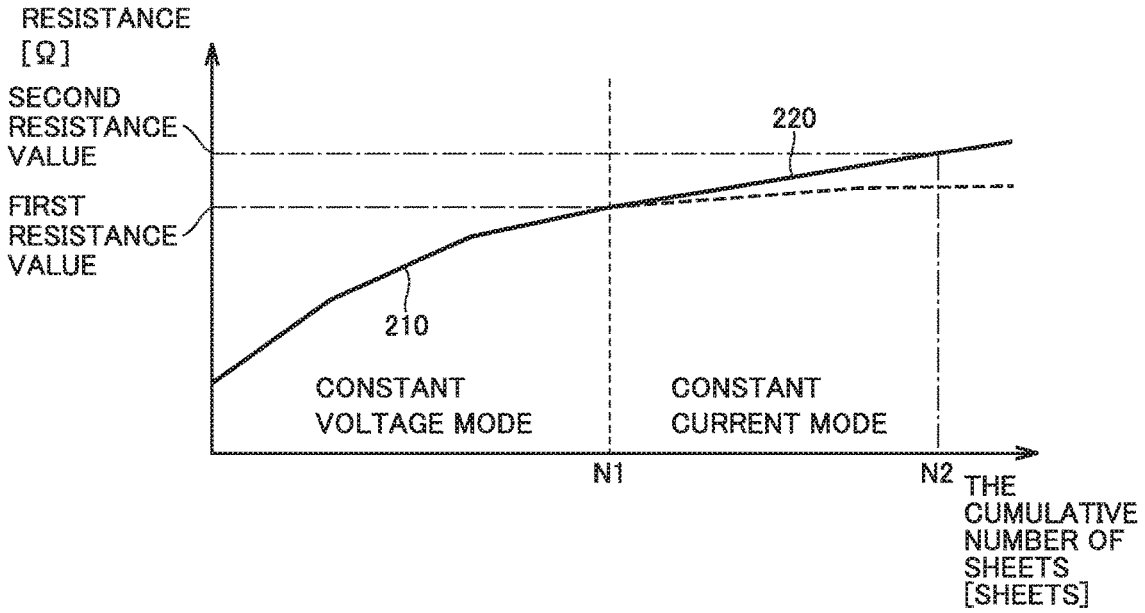
FIG. 2 is a diagram showing transition of a resistance value of the member when switching from the constant voltage mode to the constant current mode is made.

FIG. 2 shows transition of a resistance value of the member when switching from the constant voltage mode to the constant current mode is made. The abscissa in FIG. 2 represents a cumulative number of printed sheets with the use of the member and the ordinate represents a resistance value of the member.

As shown in FIG. 2, in the constant voltage mode, the resistance value of the member non-linearly varies along a curve 210. The image forming apparatus switches from the constant voltage mode to the constant current mode based on the resistance value reaching a first resistance value. In the constant current mode, the resistance value of the member varies along a straight line 220. The image forming apparatus determines that the lifetime of the member has expired based on the resistance value reaching a second resistance value (>the first resistance value).

The image forming apparatus according to the related art predicts a lifetime of the member in the constant voltage mode. More specifically, the image forming apparatus according to the related art obtains a resistance value of the member at a different cumulative number of printed sheets and predicts a cumulative number of printed sheets at the time when the resistance value reaches the second resistance value based on the obtained result. In such a case, the image forming apparatus according to the related art predicts that the resistance value of the member will vary along curve 210 (a dashed line portion) also in the constant current mode. Therefore, the image forming apparatus predicts a lifetime of the member longer than an actual lifetime thereof (a cumulative number of printed sheets N2). When printing is performed with the use of a member of which lifetime has expired, a defective image may be produced.

Figure 3:
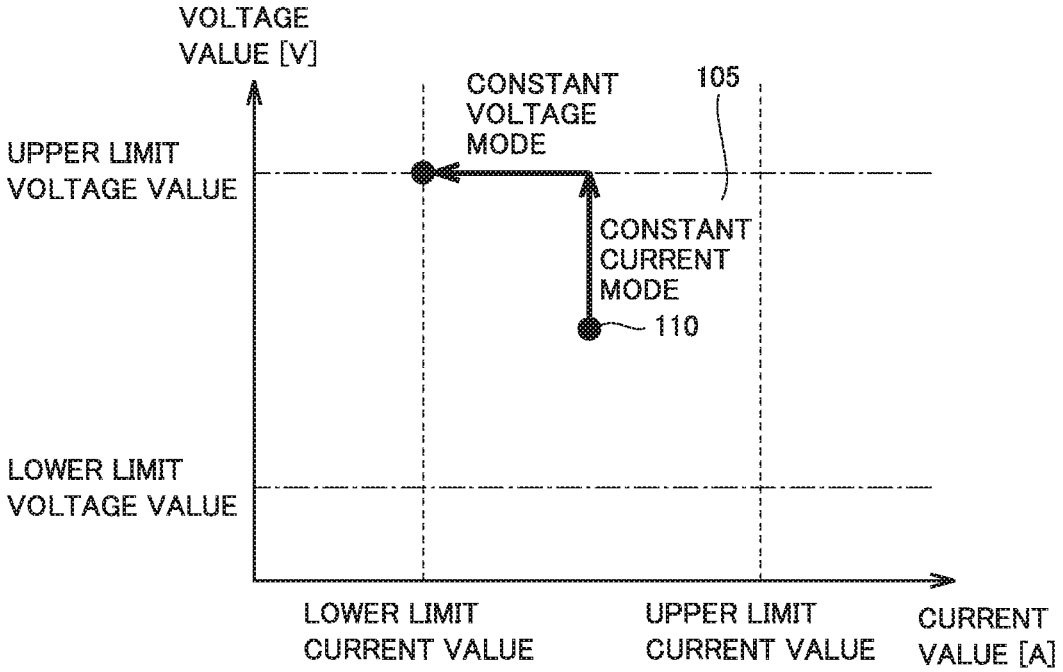
FIG. 3 is a diagram showing switching from the constant current mode to the constant voltage mode.

FIG. 3 shows switching from the constant current mode to the constant voltage mode. In the example shown in FIG. 3, the image forming apparatus initially feeds a constant current to the member. The image forming apparatus applies a constant voltage to the member when a value of the voltage generated in the member reaches the upper limit value with increase in resistance value of the member. The image forming apparatus determines that the lifetime of the member has expired when a value of a current which flows to the member reaches the lower limit value with increase in resistance value of the member.

Figure 4:
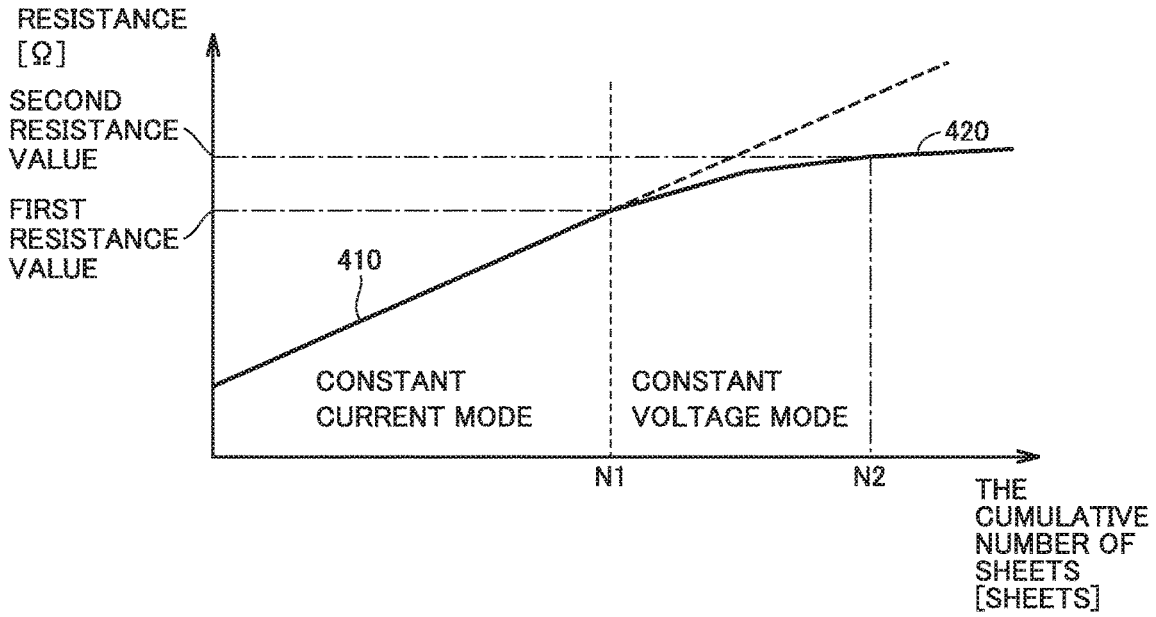
FIG. 4 is a diagram showing transition of a resistance value of the member when switching from the constant current mode to the constant voltage mode is made.

FIG. 4 shows transition of a resistance value of the member when switching from the constant current mode to the constant voltage mode is made. As shown in FIG. 4, in the constant current mode, a resistance value of the member varies along a straight line 410. The image forming apparatus switches from the constant current mode to the constant voltage mode based on the resistance value reaching the first resistance value. The resistance value of the member varies along a curve 420 in the constant voltage mode. The image forming apparatus determines that the lifetime of the member has expired based on the resistance value reaching the second resistance value (>the first resistance value).

The image forming apparatus according to the related art predicts a lifetime of the member based on a behavior of a resistance value measured in the constant current mode. In this case, the image forming apparatus according to the related art predicts that the resistance value of the member will vary along straight line 410 (the dashed line portion) also in the constant voltage mode. Therefore, the image forming apparatus predicts a lifetime of the member shorter than an actual lifetime thereof (cumulative number of printed sheets N2). The image forming apparatus according to the related art is thus unable to accurately predict a lifetime of the member when control of the member is switched from one of the constant voltage mode and the constant current mode to the other. Overview of control of an image forming apparatus according to an embodiment which can solve such a problem will be described below.

[Technical Concept]

Figure 5:
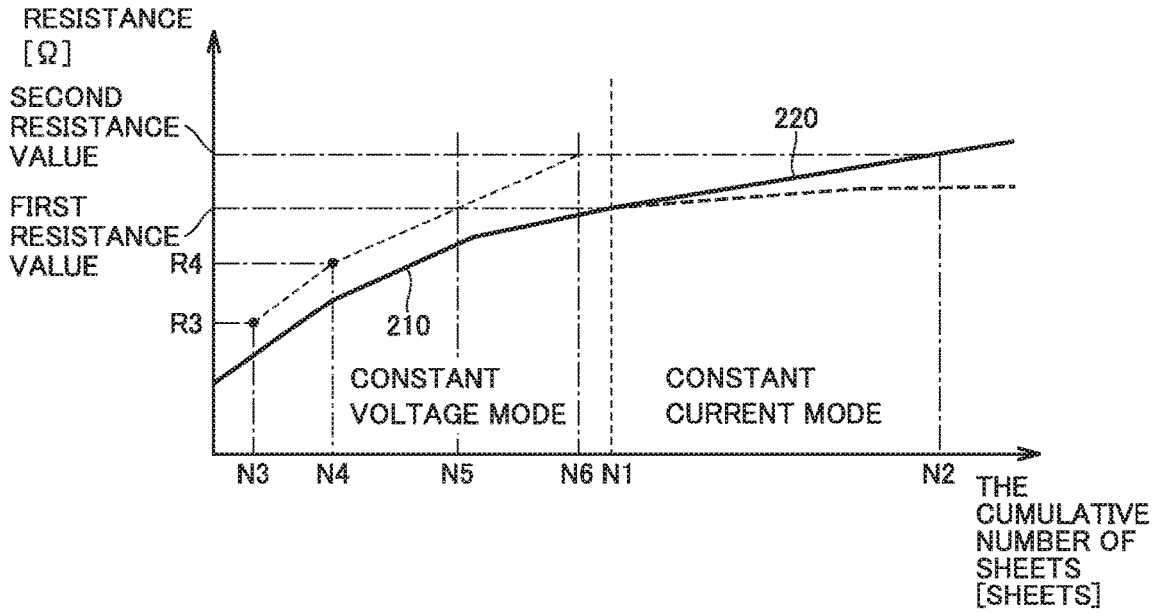
FIG. 5 is a diagram for illustrating a technical concept according to the present disclosure.

FIG. 5 is a diagram for illustrating a technical concept according to the present disclosure. In the example shown in FIG. 5, the image forming apparatus according to the embodiment switches control of a member from a constant voltage mode to a constant current mode.

The image forming apparatus according to the embodiment stores a function or a table corresponding to curve 210 in advance in a storage. Curve 210 represents reference correspondence between a cumulative number of printed sheets representing an amount of use of the member in the constant voltage mode and a resistance value of the member. The image forming apparatus obtains a resistance value of the member at a different cumulative number of printed sheets with a not-shown sensor. In the example shown in FIG. 5, the image forming apparatus obtains resistance values R3 and R4 of the member at cumulative number of printed sheets N3 and N4, respectively. The image forming apparatus obtains actual correspondence between the cumulative number of printed sheets and the resistance value from these actually measured values.

The image forming apparatus predicts a cumulative number of printed sheets N6 representing a serviceable period (a lifetime) of the member based on obtained actual correspondence (second correspondence) and reference correspondence (first correspondence) stored in the storage.

More specifically, the image forming apparatus obtains a rate of variation (that is, an inclination) in resistance value with respect to the cumulative number of sheets printed by using the member as actual correspondence. The image forming apparatus calculates a ratio between the obtained rate of variation and a rate of variation in resistance value between cumulative numbers of printed sheets N3 and N4 which is derived from the reference correspondence. The image forming apparatus corrects the reference correspondence with the calculated ratio and calculates a cumulative number of printed sheets N5 at the time when the resistance value reaches the first resistance value (that is, when switching from the constant voltage mode to the constant current mode is made), based on the corrected reference correspondence. In the example shown in FIG. 5, the actually obtained rate of variation in resistance value is higher than the rate of variation defined in the reference correspondence. Therefore, cumulative number of printed sheets N5 calculated based on the corrected reference correspondence is smaller than cumulative number of printed sheets N1 at the time when the resistance value reaches the first resistance value based on reference correspondence before correction.

The image forming apparatus calculates a rate of variation (that is, an inclination of straight line 220) in resistance value with respect to the cumulative number of printed sheets at the time when the resistance value reaches the first resistance value, based on the corrected reference correspondence. The image forming apparatus calculates cumulative number of printed sheets N6 (lifetime) at the time when the resistance value reaches the second resistance value based on the calculated rate of variation and cumulative number of printed sheets N1.

According to the above, the image forming apparatus according to the embodiment can accurately predict timing of switching between modes by correcting the reference correspondence (first correspondence) based on correspondence (second correspondence) between the actually measured amount of use of the member and the electrical characteristic value. Consequently, the image forming apparatus according to the embodiment can accurately predict a behavior of the electrical characteristic value with respect to the amount of use after switching between modes. Therefore, the image forming apparatus according to the embodiment can accurately predict a lifetime of a member even when switching between modes is made. A specific configuration of and processing in the image forming apparatus according to the embodiment will be described below.

First Embodiment (Structure of Image Forming Apparatus)

Figure 6:
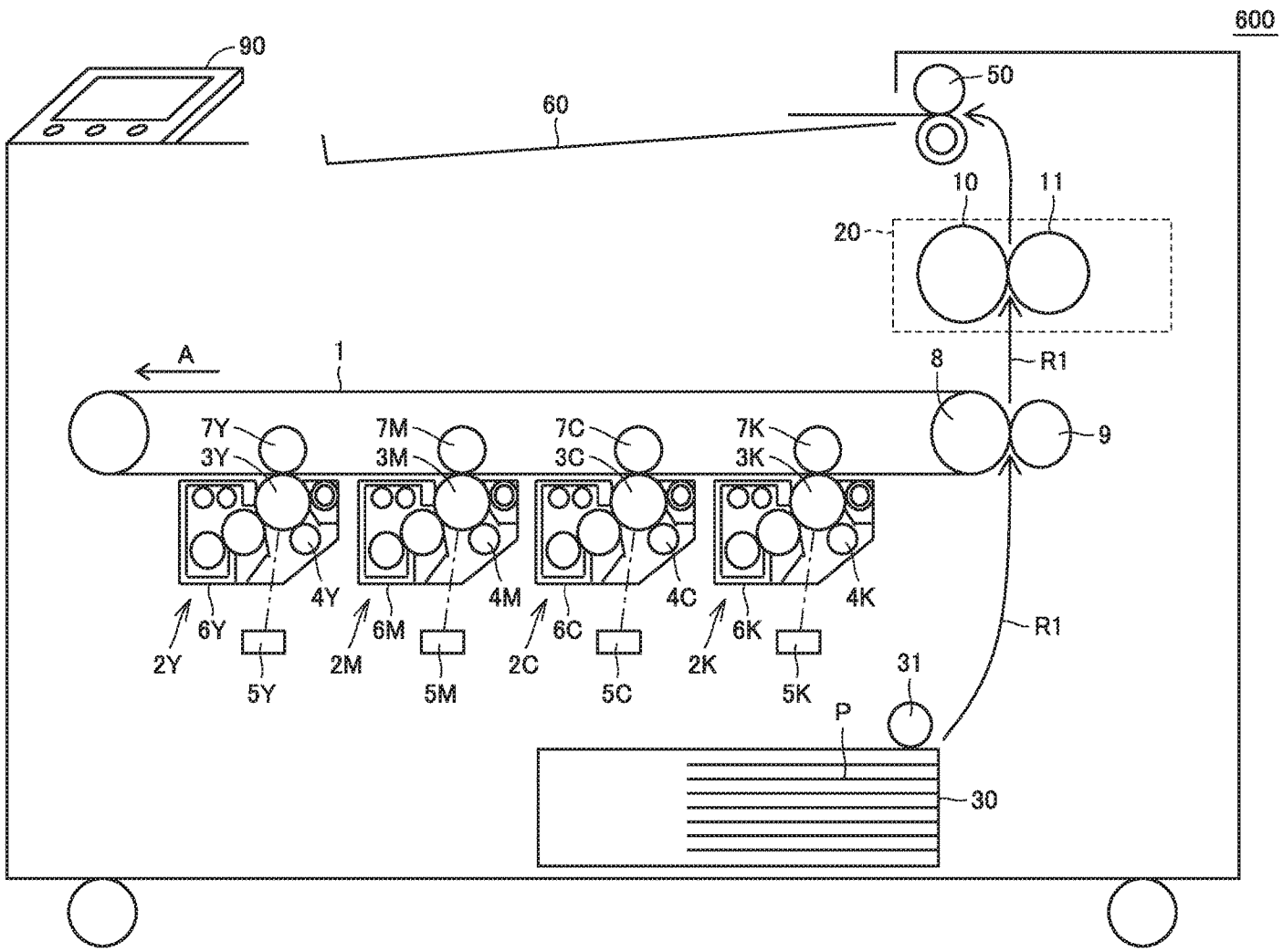
FIG. 6 is a diagram showing one example of a structure of an image forming apparatus according to a first embodiment.

FIG. 6 shows one example of a structure of an image forming apparatus 600. Image forming apparatus 600 is an electrophotographic image forming apparatus such as a laser printer or an LED printer. As shown in FIG. 6, image forming apparatus 600 includes an intermediate transfer belt 1 as a belt member substantially in a central portion therein. Four imaging units 2Y, 2M, 2C, and 2K corresponding to respective colors of yellow (Y), magenta (M), cyan (C), and black (K) are arranged as being aligned along intermediate transfer belt 1 under a lower horizontal portion of intermediate transfer belt 1. Imaging units 2Y, 2M, 2C, and 2K include photoconductors 3Y, 3M, 3C, and 3K configured to be able to carry toner images, respectively.

Around photoconductors 3Y, 3M, 3C, and 3K which are image carriers, charging rollers 4Y, 4M, 4C, and 4K for charging corresponding photoconductors, exposure apparatuses 5Y, 5M, 5C, and 5K, development apparatuses 6Y, 6M, 6C, and 6K, and primary transfer rollers 7Y, 7M, 7C, and 7K opposed to photoconductors 3Y, 3M, 3C, and 3K with intermediate transfer belt 1 being interposed are sequentially arranged along a direction of rotation thereof, respectively. Primary transfer rollers 7Y, 7M, 7C, and 7K are arranged in proximity to corresponding photoconductors 3Y, 3M, 3C, and 3K, respectively.

A secondary transfer roller 9 is brought in pressure contact with a portion of intermediate transfer belt 1 supported by an intermediate transfer belt drive roller 8. Secondary transfer is performed in a region where secondary transfer roller 9 and intermediate transfer belt drive roller 8 are in contact with each other. A fixation apparatus 20 including a fixation roller 10 and a pressurization roller 11 is arranged at a position downstream in a transportation path R1, in a stage subsequent to a secondary transfer region.

A paper feed cassette 30 is removably arranged in a lower portion of image forming apparatus 600. Paper P loaded and accommodated in paper feed cassette 30 is sent to transportation path R1 one by one from the top sheet of paper with rotation of a paper feed roller 31.

Control panel 90 is arranged in an upper portion of image forming apparatus 600. Control panel 90 is constituted of a screen where a touch panel and a display are superimposed on each other and a physical button by way of example.

Though image forming apparatus 600 adopts a tandem type intermediate transfer scheme in the example above, limitation thereto is not intended.

(General Operations by Image Forming Apparatus)

General operations by image forming apparatus 600 constructed above will now be described. An image signal is input to a CPU 810 which will be described later from an external apparatus (for example, a personal computer). CPU 810 creates a digital image signal resulting from color conversion of this image signal into yellow, cyan, magenta, and black. CPU 810 has exposure apparatuses 5Y, 5M, 5C, and 5K in imaging units 2Y, 2M, 2C, and 2K emit light based on the created digital signal for exposure.

Electrostatic latent images formed on photoconductors 3Y, 3M, 3C, and 3K are developed by development apparatuses 6Y, 6M, 6C, and 6K, respectively, and become toner images of respective colors. The toner images of respective colors are successively superimposed on intermediate transfer belt 1 which moves in a direction shown with an arrow A in FIG. 6 and primarily transferred owing to functions of primary transfer rollers 7Y, 7M, 7C, and 7K.

The toner images thus formed on intermediate transfer belt 1 are secondarily transferred together to paper P owing to a function of secondary transfer roller 9. The toner image secondarily transferred to paper P reaches fixation apparatus 20. The toner image is fixed to paper P owing to functions of heated fixation roller 10 and pressurization roller 11. Paper P to which the toner image has been fixed is ejected to a paper ejection tray 60 through a paper ejection roller 50.

(Imaging Unit)

A specific construction of the imaging unit will be described below. Since imaging units 2Y, 2M, 2C, and 2K are identical in construction, the construction of imaging unit 2Y will be described by way of example.

Figure 7:
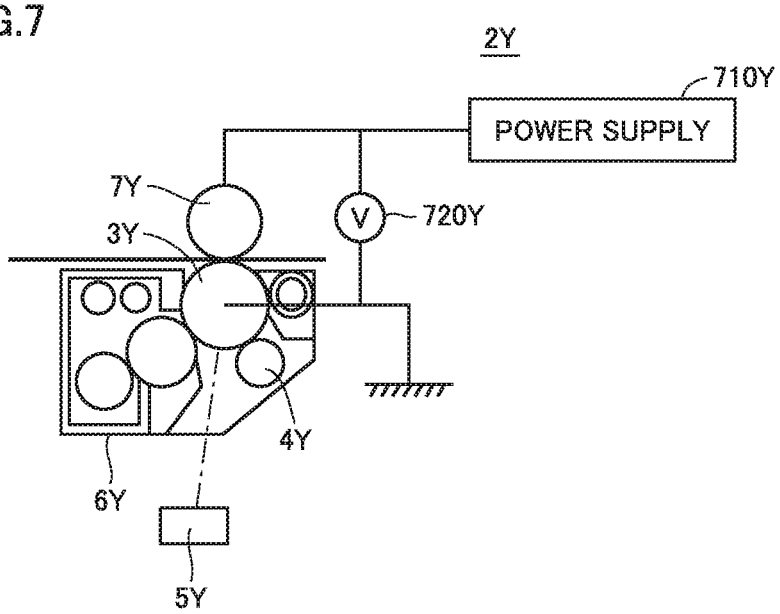
FIG. 7 is a diagram showing a construction of an imaging unit according to the first embodiment.

FIG. 7 is a diagram showing a construction of imaging unit 2Y. Referring to FIG. 7, imaging unit 2Y further includes a power supply 710Y and a voltage sensor 720Y in addition to photoconductor 3Y, charging roller 4Y, exposure apparatus 5Y, development apparatus 6Y, and primary transfer roller 7Y described above.

Power supply 710Y is configured to be able to switch between a constant voltage mode and a constant current mode. Power supply 710Y applies a constant voltage to primary transfer roller 7Y in the constant voltage mode and feeds a constant current to primary transfer roller 7Y in the constant current mode.

Voltage sensor 720Y functions as a sensor for measuring an electrical characteristic value of primary transfer roller 7Y. By way of example, voltage sensor 720Y is configured to measure a value of a voltage generated in primary transfer roller 7Y when the power supply 710Y feeds a constant current (for example, 30 μA) to primary transfer roller 7Y.

Suffixes representing yellow "Y", magenta "M", cyan "C", and black "K" may not be provided below for components of respective colors described above. A component denoted without the suffix collectively represents components of four colors. For example, photoconductor 3 collectively represents photoconductors 3Y, 3M, 3C, and 3K.

(Relation of Electrical Connection in Image Forming Apparatus)

Figure 8:
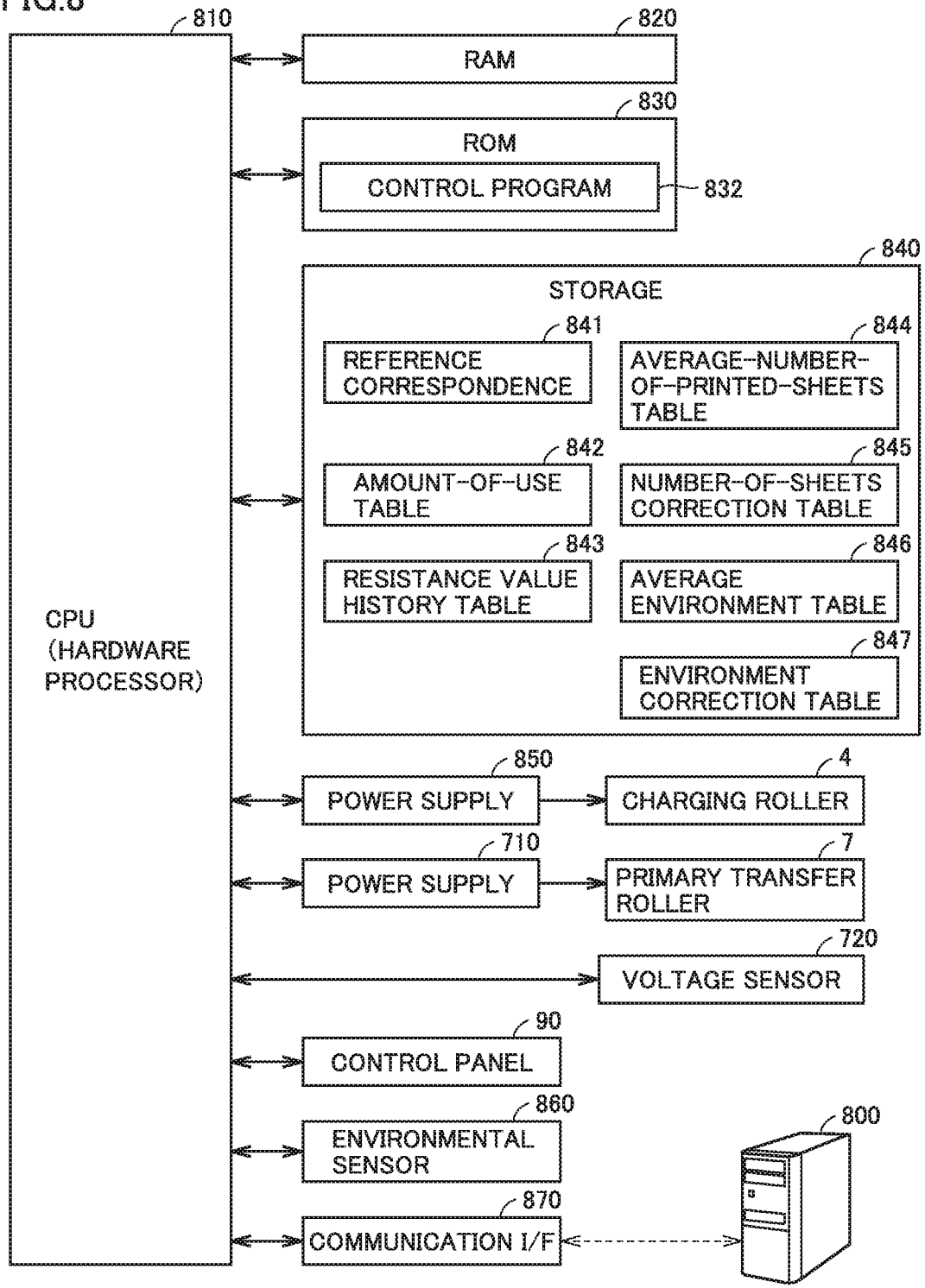
FIG. 8 is a diagram showing one example of an electrical configuration of the image forming apparatus according to the first embodiment.

FIG. 8 is a diagram showing one example of an electrical configuration of image forming apparatus 600 according to a first embodiment. Image forming apparatus 600 includes central processing unit (CPU) 810 which functions as a hardware processor of image forming apparatus 600. CPU 810 is electrically connected to a random access memory (RAM) 820, a read only memory (ROM) 830, a storage 840, a power supply 850, power supply 710, control panel 90, an environmental sensor 860, and a communication interface (I/F) 870. CPU 810 controls an operation of each connected device by reading and executing a control program 832 stored in ROM 830.

RAM 820 functions as a working memory for CPU 810 to execute control program 832. Storage 840 is implemented by a non-volatile memory such as a hard disk drive. Storage 840 stores reference correspondence 841, an amount-of-use table 842, a resistance value history table 843, an average-number-of-printed-sheets table 844, a number-of-sheets correction table 845, an average environment table 846, and an environment correction table 847.

Amount-of-use table 842 stores an amount of use of primary transfer roller 7 of each color. The amount of use includes, for example, a cumulative number of sheets printed by using primary transfer roller 7 (which is also referred to as a "cumulative number of sheets" below), the number of rotations of primary transfer roller 7, and a running distance. The amount of use for each color stored in amount-of-use table 842 is updated by CPU 810 each time primary transfer roller 7 is used.

Resistance value history table 843 stores a history of resistance values of primary transfer roller 7 for each color. More specifically, CPU 810 calculates a resistance value of primary transfer roller 7 based on a result of measurement with voltage sensor 720 obtained at prescribed timing. CPU 810 has the calculated resistance value and the cumulative number of sheets at the prescribed timing saved in resistance value history table 843 in association with each other. Each piece of other data stored in storage 840 will be described later.

Power supply 850 applies a prescribed voltage to charging roller 4. Photoconductor 3 is thus charged by charging roller 4.

Power supply 710 applies a constant voltage or a constant current to primary transfer roller 7 as described above. Voltage sensor 720 detects a voltage generated in the primary transfer roller and outputs a result of detection to CPU 810.

Control panel 90 outputs an operation content accepted from a user (for example, a coordinate position on the touch panel) to CPU 810.

Environmental sensor 860 measures a temperature and a humidity in image forming apparatus 600 and outputs a result of measurement to CPU 810.

Communication I/F 870 is implemented by a wireless local area network (LAN) card by way of example. CPU 810 is configured to be able to communicate with a server 800 connected to LAN or wide area network (WAN) through communication I/F 870. Server 800 accepts input of information representing a state of image forming apparatus 600, for example, in order for a manufacturer or a seller of image forming apparatus 600 to manage image forming apparatus 600.

(First Correspondence)

Figures 9A, 9B:
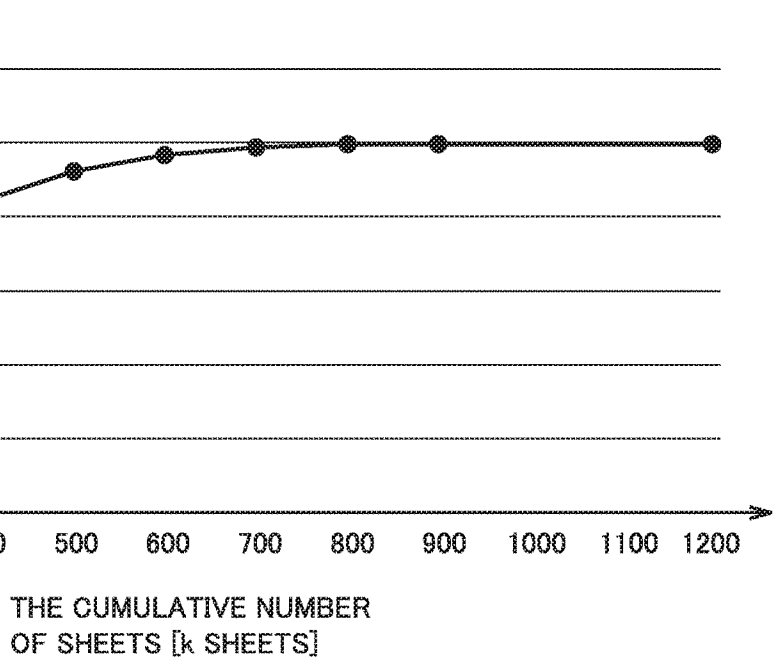
FIGS. 9A and 9B are diagrams for illustrating reference correspondence stored in a storage.

FIGS. 9A and 9B are diagrams for illustrating reference correspondence 841 stored in storage 840. FIG. 9A shows one example of a data structure of reference correspondence 841 according to one aspect. FIG. 9B is a diagram visually showing reference correspondence 841.

Referring to FIG. 9A, reference correspondence 841 holds relation between an amount of use of primary transfer roller 7 in the constant voltage mode and a rate of variation in electrical characteristic value of primary transfer roller 7. In the example shown in FIG. 9A, the amount of use of primary transfer roller 7 is represented as a cumulative number of sheets printed by using the primary transfer roller and the rate of variation is represented as an inclination of a resistance value of primary transfer roller 7 with respect to the amount of use. The amount of use of primary transfer roller 7 is divided into a plurality of successive sections. Each section holds one value of the rate of variation in electrical characteristic value.

As shown in FIG. 9A, the rate of variation is lower with increase in cumulative number of sheets. As shown in FIG. 9B, the resistance value of primary transfer roller 7 varies like a logarithmic function with increase in cumulative number of sheets in the constant voltage mode. Each rate of variation held in reference correspondence 841 has a value calculated in advance through experiments under a predetermined condition. The predetermined condition includes predetermined temperature and humidity, a predetermined value of a voltage applied to primary transfer roller 7, and a predetermined number of printed sheets per print job.

Though storage 840 is configured to store reference correspondence 841 in a table format in the example above, it may be configured to store a function exhibiting a curve shown in FIG. 9B in another embodiment.

(Prediction of Lifetime of Primary Transfer Roller 7)

Processing for predicting a serviceable period (a lifetime) of primary transfer roller 7 with reference to reference correspondence 841 will now be described with reference to a specific example.

Figure 10:
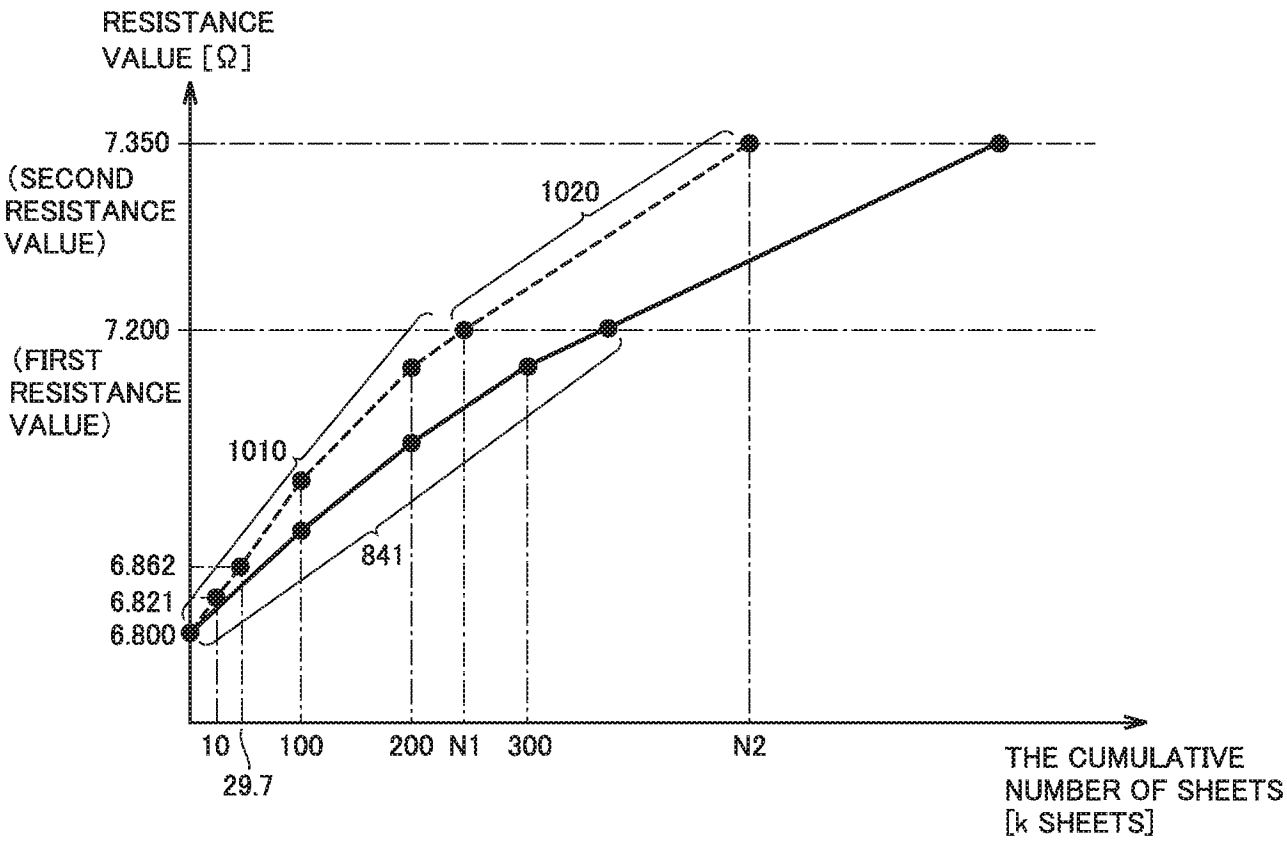
FIG. 10 is a diagram for illustrating processing for predicting a serviceable period of a primary transfer roller.

FIG. 10 is a diagram for illustrating processing for predicting a serviceable period of primary transfer roller 7. The abscissa represents a cumulative number of sheets printed by using primary transfer roller 7, and the ordinate represents a resistance value of primary transfer roller 7. By way of example, the resistance value of primary transfer roller 7 is assumed as 6.8 log Ω when the cumulative number of sheets is 0, as 6.821 log Ω when the cumulative number of sheets is 10 k (where k means 1000), and as 6.862 log Ω when the cumulative number of sheets is 29.7 k. These values are calculated by CPU 810 based on a result of output from voltage sensor 720.

Initially, CPU 810 calculates a rate of variation in resistance value of primary transfer roller 7 when the cumulative number of sheets is from 10 k to 29.7 k as P1=(6.862−6.821)/(29.7−10)*100=0.205 [log Ω/100 k sheets].

By referring to reference correspondence 841, CPU 810 specifies that a reference rate of variation PA1 in resistance value when the cumulative number of sheets is from 10 k to 29.7 k as 0.16 [log Ω/100 k sheets]. Reference rate of variation PA1 is a rate of variation estimated from reference correspondence 841. In contrast, rate of variation P1 is an actual rate of variation calculated based on a result of measurement with voltage sensor 720. CPU 810 then calculates a ratio RA of rate of variation P1 to reference rate of variation PA1. In the example above, ratio RA is calculated as ratio RA=0.205/0.16−1.3.

CPU 810 corrects each reference rate of variation held in reference correspondence 841 by multiplying each reference rate of variation by ratio RA and calculates cumulative number of sheets N1 at the time of switching to the constant current mode based on corrected correspondence 1010.

More specifically, CPU 810 calculates in accordance with an expression (1) below, a resistance value R 200 k of primary transfer roller 7 at the time point of 200 k sheets before reaching a first resistance value (7.2 log Ω).

$$\begin{aligned} R\ 200\ k &= \text{initial resistance value} + \text{ratio } RA \times \\ &\quad (\text{reference rate of variation } PA1 + \\ &\quad \text{reference rate of variation } PA2) \\ &= 6.8 + 1.3 \times (0.16 + 0.12) \\ &= 7.16\ [\log\Omega] \end{aligned} \qquad \text{<Expression 1>}$$

A reference rate of variation PA2 is a rate of variation at the time when cumulative number of sheets estimated from reference correspondence 841 is from 100 k to 200 k. CPU 810 calculates in accordance with an expression (2) below, a difference D1 between cumulative number of sheets 200 k and cumulative number of sheets N1.

$$\begin{aligned} D1 &= (\text{first resistance value} - R\ 200\ k)/ \\ &\quad (\text{reference rate of variation } PA3 \times \\ &\quad \text{ratio } RA) \times 100 \\ &= (7.2 - 7.16)/(0.08 \times 1.3) \times 100 \\ &= 38.5\ [k \text{ sheets}] \end{aligned} \qquad \text{<Expression 2>}$$

A reference rate of variation PA3 is a rate of variation at the time when the cumulative number of sheets estimated from reference correspondence 841 is from 200 k to 300 k. Based on the result above, CPU 810 calculates the cumulative number of sheets at the time of switching to the current mode, that is, when the resistance value reaches the first resistance value, as 238.5 k.

Then, CPU 810 calculates a rate of variation P3 in the constant current mode (that is, an inclination of a straight line 1020)=reference rate of variation PA3×ratio RA=0.104. CPU 810 calculates in accordance with an expression (3) below, cumulative number of printed sheets N2 corresponding to a serviceable period of primary transfer roller 7 based on rate of variation P3 and cumulative number of sheets N1.

$$\begin{aligned} N2 &= (\text{second resistance value} - \text{first resistance value})/ \\ &\quad \text{rate of variation } P3 \times 100 + \\ &\quad \text{cumulative number of sheets } N1 \\ &= (7.35 - 7.2)/0.104 \times 100 + 238.5\ k \text{ sheets} \\ &= 382.7\ k \text{ sheets} \end{aligned} \qquad \text{<Expression 3>}$$

(Control Structure)

Figure 11:
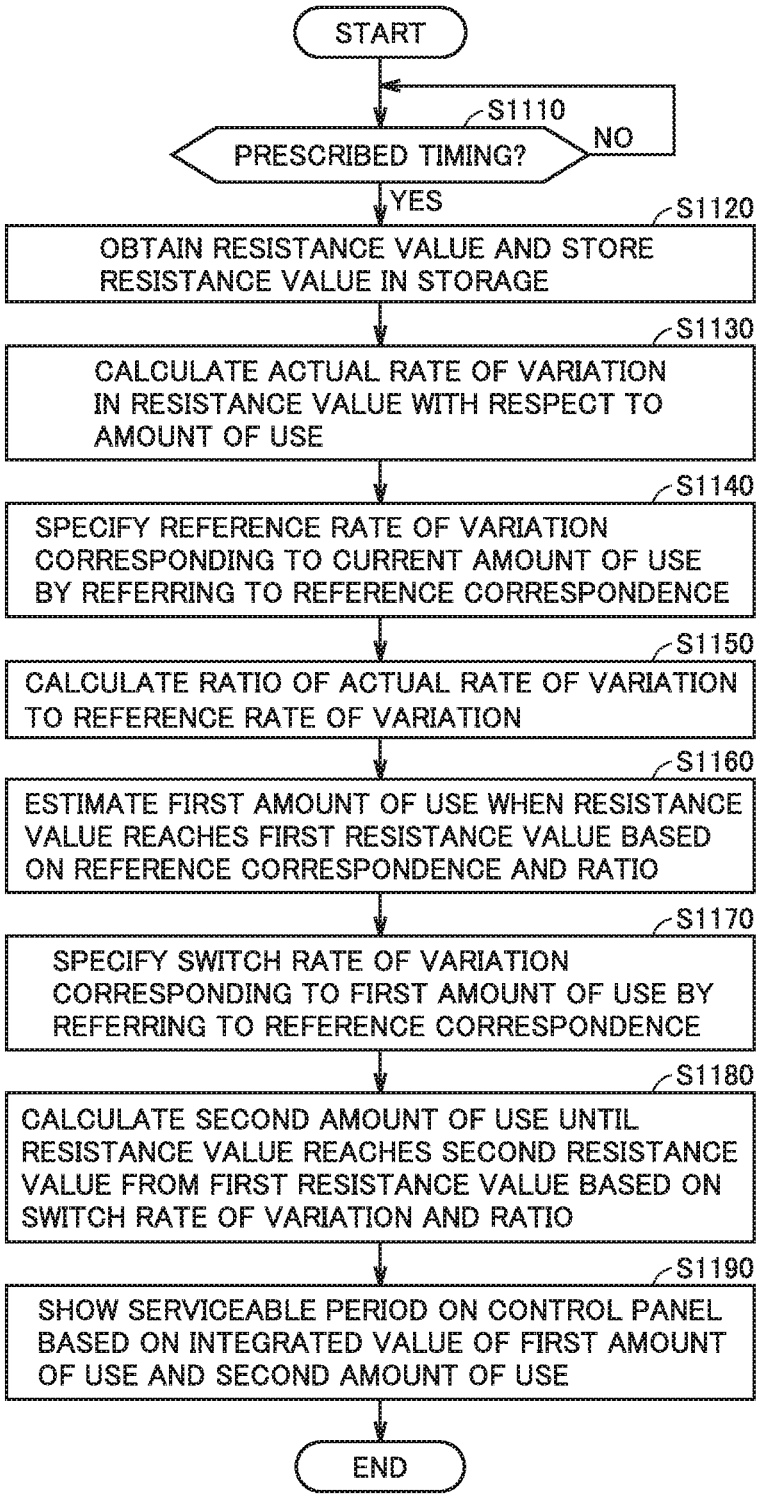
FIG. 11 is a flowchart showing processing for calculating a lifetime (a serviceable period) of the primary transfer roller.

FIG. 11 is a flowchart showing a series of processing for calculating a lifetime (a serviceable period) of primary transfer roller 7. Each processing shown in FIG. 11 is performed by execution of control program 832 by CPU 810.

In step S1110, CPU 810 determines whether or not prescribed timing has come. The prescribed timing includes, for example, timing of start of supply of power to image forming apparatus 600, timing when the cumulative number of sheets printed by using primary transfer roller 7 reaches a prescribed number of sheets (for example, every 10 k sheets), and timing designated and input by a user through control panel 90. CPU 810 performs processing in step S1120 when it determines that the prescribed timing has come.

In step S1120, CPU 810 obtains a resistance value as an electrical characteristic value of primary transfer roller 7 based on a result of measurement with voltage sensor 720. CPU 810 has the obtained resistance value and the cumulative number of sheets at the timing when the resistance value was obtained stored in resistance value history table 843 in association with each other.

In step S1130, CPU 810 calculates an actual rate of variation in resistance value with respect to an amount of use of primary transfer roller 7 by referring to resistance value history table 843.

In step S1140, CPU 810 specifies a reference rate of variation corresponding to a current amount of use (the cumulative number of sheets stored in amount-of-use table 842) by referring to reference correspondence 841. By way of example, when the current cumulative number of sheets is 250 k, the corresponding reference rate of variation is 0.08 [log Ω/100 k sheets].

In step S1150, CPU 810 calculates ratio RA of the actual rate of variation to the reference rate of variation. In step S1160, CPU 810 estimates cumulative number of sheets N1 (a first amount of use) at the time when the resistance value of primary transfer roller 7 reaches the first resistance value based on reference correspondence 841 and ratio RA.

In step S1170, CPU 810 specifies a reference rate of variation (which is also referred to as a "switch rate of variation" below) at the time when the cumulative number of sheets attains to N1 by referring to reference correspondence 841.

In step S1180, CPU 810 calculates the number of printed sheets (a second amount of use) until the resistance value reaches the second resistance value from the first resistance value based on a value calculated by multiplying the switch rate of variation by ratio RA.

In step S1190, CPU 810 calculates the sum of the first amount of use and the second amount of use as cumulative number of sheets N2 (that is, a serviceable period of primary transfer roller 7). CPU 810 has the calculated serviceable period of primary transfer roller 7 shown on control panel 90.

According to the above, image forming apparatus 600 according to the embodiment can accurately predict the timing of switching between the modes by correcting reference correspondence 841 (first correspondence) stored in advance, based on correspondence (second correspondence) between a value of an actually measured resistance of primary transfer roller 7 and the cumulative number of sheets printed by using primary transfer roller 7. Consequently, image forming apparatus 600 can accurately predict a behavior of the resistance value of primary transfer roller 7 after switching between modes. Therefore, image forming apparatus 600 can accurately predict a serviceable period of primary transfer roller 7 even though switching between modes is made.

A rate of variation in resistance value with respect to an amount of use of primary transfer roller 7 may vary in response to variation in condition of use of image forming apparatus 600. In such a case as well, image forming apparatus 600 according to the embodiment calculates a serviceable period of primary transfer roller 7 at every prescribed timing shown in step S1110. Therefore, even though a rate of variation in resistance value with respect to an amount of use of primary transfer roller 7 varies, image forming apparatus 600 can calculate each time, a serviceable period of primary transfer roller 7 in accordance with the variation.

Though image forming apparatus 600 is configured to calculate a rate of variation based on two recent resistance values among resistance values stored in resistance value history table 843 in the example above, it may be configured to calculate a rate of variation based on three or more resistance values.

Though image forming apparatus 600 is configured to predict a serviceable period of primary transfer roller 7 based on a resistance value of primary transfer roller 7 in the example above, it may predict a serviceable period of the primary transfer roller based on other parameters. For example, image forming apparatus 600 may substantially regard a value of a voltage generated in primary transfer roller 7 at the time when a constant current is fed to primary transfer roller 7 as a resistance value.

In another example, image forming apparatus 600 may predict a serviceable period of primary transfer roller 7 based on a value of a current which flows to primary transfer roller 7 at the time when a constant voltage is applied to primary transfer roller 7. In such a case, a current value and a resistance value satisfy reciprocal relation. Therefore, image forming apparatus 600 predicts the cumulative number of sheets at the time when a value of a measured current becomes smaller than a predetermined current value as a serviceable period of primary transfer roller 7.

Though a configuration for predicting a serviceable period of primary transfer roller 7 is described in the example above, image forming apparatus 600 can predict also a serviceable period of another member with a similar technique. Examples of another member include charging roller 4 and secondary transfer roller 9. For example, in predicting a serviceable period of charging roller 4, image forming apparatus 600 includes a sensor for measuring a resistance value of charging roller 4 and storage 840 stores correspondence between an amount of use and an electrical characteristic value (for example, a resistance value) of charging roller 4. Power supply 850 is configured to be able to switch between the constant voltage mode and the constant current mode similarly to power supply 710.

Figure 12:
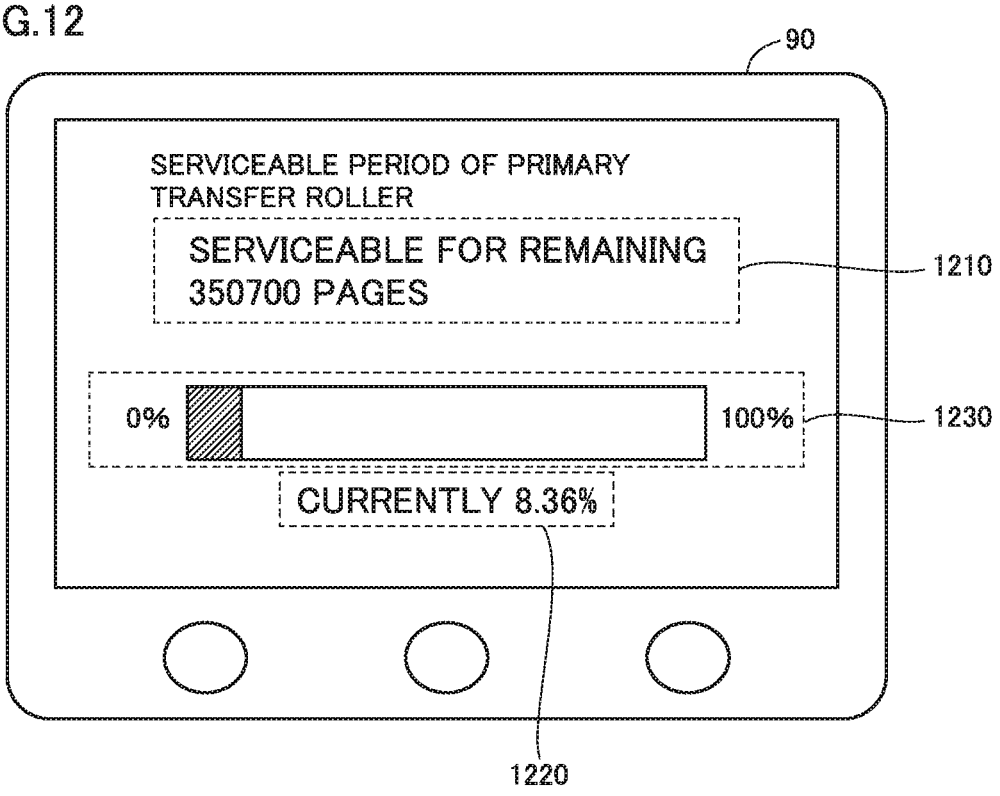
FIG. 12 is a diagram showing one example of a manner of notification of a serviceable period of the primary transfer roller.

FIG. 12 is a diagram showing one example of a manner of notification of a serviceable period of primary transfer roller 7. In one aspect, CPU 810 has a serviceable period of primary transfer roller 7 shown on control panel 90.

In the example shown in FIG. 12, CPU 810 has messages 1210 and 1220 and a meter 1230 shown on control panel 90. Message 1210 indicates the number of sheets resulting from subtraction of a current cumulative number of sheets from cumulative number of sheets N2, that is, the number of remaining sheets on which printing can be done by using primary transfer roller 7. Message 1220 indicates a proportion of the current cumulative number of sheets to cumulative number of sheets N2. Meter 1230 visually shows the proportion indicated by message 1220.

According to the above, a user can readily visually understand how much primary transfer roller 7 was used until now and how much more the primary transfer roller can be used.

In another aspect, CPU 810 may have a lifetime of primary transfer roller 7 shown on control panel 90 as a time period (for example, three months more).

Image forming apparatus 600 may be configured to notify, when the proportion indicated by message 1220 exceeds a prescribed proportion (for example, 90%), server 800 which manages image forming apparatus 600, of that fact. A serviceperson can thus efficiently replace a member of which lifetime will soon expire in the image forming apparatus including such a member. Image forming apparatus 600 can be prevented from having a long period (a downtime) during which printing cannot be performed due to expiration of the lifetime of a member.

(Prediction of Lifetime after Transition to Constant Current Mode)

Image forming apparatus 600 according to the embodiment can calculate a serviceable period of primary transfer roller 7 also after transition from the constant voltage mode to the constant current mode.

Figure 13:
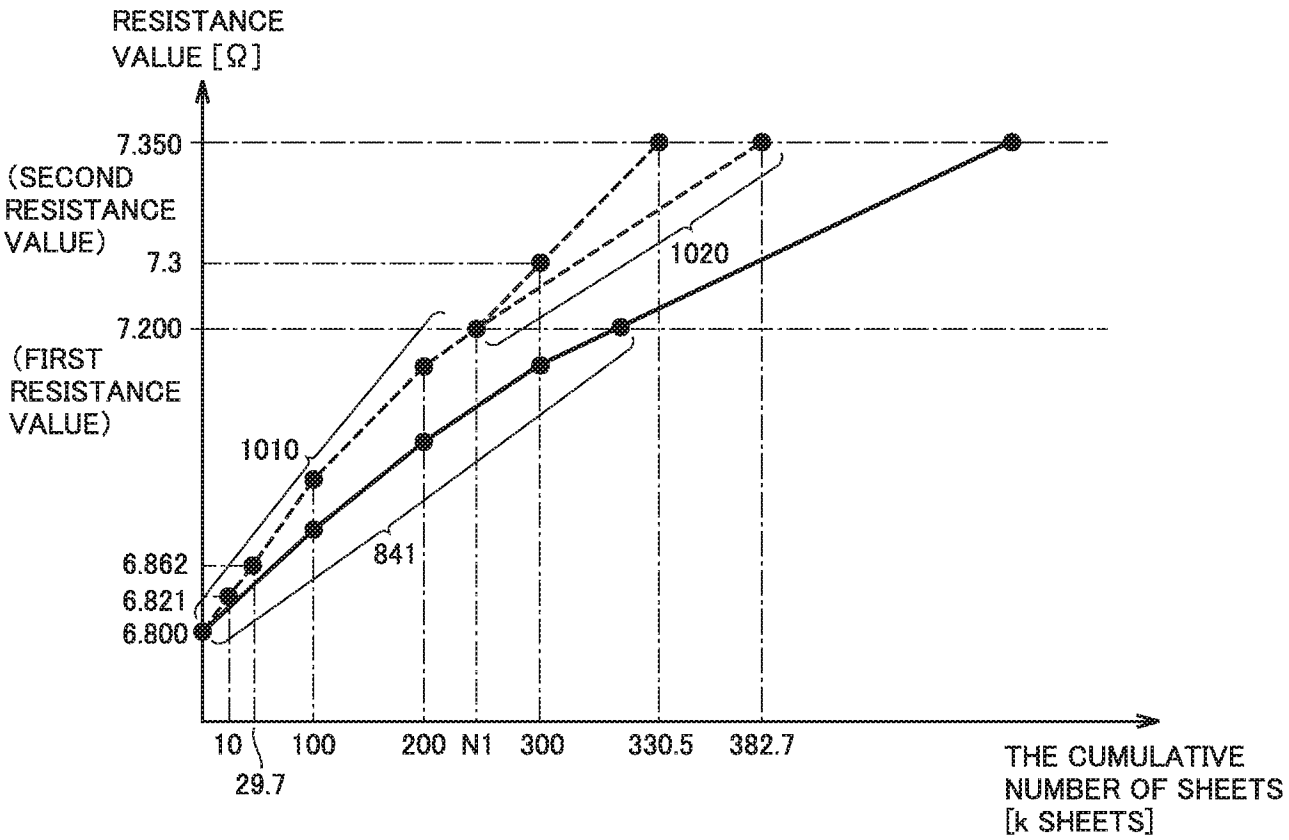
FIG. 13 is a diagram for illustrating processing for predicting a serviceable period of the primary transfer roller after transition to the constant current mode.

FIG. 13 is a diagram for illustrating processing for predicting a serviceable period of primary transfer roller 7 after transition to the constant current mode. The abscissa represents a cumulative number of sheets printed by using primary transfer roller 7 and the ordinate represents a resistance value of primary transfer roller 7.

In the example shown in FIG. 10, a serviceable period of primary transfer roller 7 is predicted as 382.7 k sheets when the cumulative number of sheets is 29.7 k in the constant voltage mode. In FIG. 13, by way of example, a serviceable period of primary transfer roller 7 is again calculated when the cumulative number of sheets is 300 k in the constant current mode.

CPU 810 calculates a resistance value R 300 k of primary transfer roller 7 at the time when the cumulative number of sheets is 300 k as 7.3 log Ω based on a result of measurement with voltage sensor 720.

CPU 810 calculates in accordance with an expression (4) below, rate of variation P3 in resistance value of primary transfer roller 7 with respect to an amount of use of primary transfer roller 7 in the constant current mode.

$$\begin{aligned} P3 &= (R\ 300\ k - \text{first resistance value})/ \\ &\quad \{(\text{current cumulative number of sheets} - \\ &\quad \text{cumulative number of sheets } N1)/100\} \\ &= (7.3 - 7.2)/\{(300\ k - 238.5\ k)/100\} \\ &= 0.163\ [\log\Omega/100\ k\ \text{sheets}] \end{aligned} \quad \text{<Expression 4>}$$

In the constant current mode, rate of variation P3 does not vary in principle. Therefore, CPU 810 calculates again in accordance with an expression (5) below, cumulative number of sheets N2 based on calculated rate of variation P3 and cumulative number of sheets N1 (238.5 k).

$$\begin{aligned} N2 &= (\text{second resistance value} - \text{first resistance value})/ \\ &\quad \text{rate of variation } P3 \times 100 + \\ &\quad \text{cumulative number of sheets } N1 \\ &= (7.35 - 7.2)/0.163 \times 100 + 238.5\ k\ \text{sheets} \\ &= 330.5\ k\ \text{sheets} \end{aligned} \quad \text{<Expression 5>}$$

According to the above, image forming apparatus 600 according to the embodiment can modify a serviceable period of primary transfer roller 7 based on a value of a resistance of primary transfer roller 7 actually measured in the constant current mode.

[Modification]

(Correction Based on Average Number of Printed Sheets Per Print Job)

Charging roller 4, primary transfer roller 7, and secondary transfer roller 9 of image forming apparatus 600 according to a modification are formed of an ion conductive material of which charges (carriers) are ions. The ion conductive material is shorter in its serviceable period as an amount of use per unit time is larger, because the ion conductive material is more uneven in ion distribution therein (that is, a resistance is higher) as the amount of use per unit time is larger.

Image forming apparatus 600 according to the modification corrects a serviceable period of a member formed of the ion conductive material with an average number of printed sheets per one print job as an indicator of an amount of use per unit time of the ion conductive material. By way of example, processing for correcting a serviceable period of primary transfer roller 7 will be described.

Image forming apparatus 600 according to the modification corrects a serviceable period of primary transfer roller 7 based on average-number-of-printed-sheets table 844 and number-of-sheets correction table 845 stored in storage 840.

Average-number-of-printed-sheets table 844 stores an average number of printed sheets per one print job for each color. CPU 810 updates average-number-of-printed-sheets table 844 each time a print job is input.

FIG. 14 shows one example of a data structure in number-of-sheets correction table 845. As shown in FIG. 14, number-of-sheets correction table 845 holds an average number of printed sheets per one print job and a correction coefficient in association with each other. More specifically, number-of-sheets correction table 845 is configured such that the correction coefficient is smaller as the average number of printed sheets is larger.

CPU 810 predicts at prescribed timing, a serviceable period of primary transfer roller 7 as being 330.5 k sheets in accordance with the method described above. CPU 810 further specifies a correction coefficient corresponding to the average number of printed sheets at the prescribed timing by referring to average-number-of-printed-sheets table 844 and number-of-sheets correction table 845. By way of example, when the average number of printed sheets is 5.0, CPU 810 specifies the correction coefficient as 1.2.

CPU 810 obtains corrected serviceable period of 396.6 k sheets by multiplying serviceable period of 330.5 k sheets of primary transfer roller 7 calculated with the method described above by specified correction coefficient of 1.2. CPU 810 according to the modification is configured to have the corrected serviceable period of primary transfer roller 7 shown on control panel 90.

According to the above, when image forming apparatus 600 according to the modification predicts a serviceable period of a member formed of the ion conductive material, it can predict a more accurate serviceable period by taking into account an amount of use per unit time of the member.

In another aspect, image forming apparatus 600 may be configured to correct a serviceable period of a member formed of the ion conductive material based on an amount of use per unit time during an immediately preceding prescribed period (for example, one month).

(Correction Based on Environment)

A rate of increase in resistance value of the ion conductive material is higher as a temperature or a humidity is lower. This is because, as the temperature or the humidity is lower, mobility of ions is lower and an ion distribution in the ion conductive material is more uneven (that is, a resistance is higher).

Image forming apparatus 600 according to the modification corrects a serviceable period of a member formed of the ion conductive material based on a temperature and a humidity detected by environmental sensor 860.

More specifically, image forming apparatus 600 according to the modification corrects a serviceable period based on average environment table 846 and environment correction table 847 stored in storage 840.

Average environment table 846 stores, for each member formed of the ion conductive material, an average temperature and an average humidity during a period in which the member is attached to image forming apparatus 600. CPU 810 measures a temperature and a humidity with environmental sensor 860 at a prescribed time interval (for example, every ten minutes) and updates an average temperature and an average humidity held in average environment table 846.

FIG. 15 shows one example of a data structure in environment correction table 847. As shown in FIG. 15, environment correction table 847 holds an average environment and a correction coefficient in association with each other. More specifically, the environment correction table holds five average environments of an "HH environment," an "NN-HH environment," an "NN environment," an "NN-LL environment," and an "LL environment" as well as a correction coefficient associated with each of them.

The "HH environment" refers, for example, to an environment in which an average temperature is not lower than 25° C. and an average humidity is not lower than 70%. The "NN-HH environment" refers, for example, to an environment in which an average temperature is not lower than 25° C. and an average humidity is not lower than 30% and lower than 70% and an environment in which an average temperature is not lower than 15° C. and lower than 25° C. and an average humidity is not lower than 70%. The "NN environment" refers, for example, to an environment in which an average temperature is not lower than 15° C. and lower than 25° C. and an average humidity is not lower than 30% and lower than 70%. The "NN-LL environment" refers, for example, to an environment in which an average temperature is not lower than 15° C. and lower than 25° C. and an average humidity is lower than 30% and an environment in which an average temperature is lower than 15° C. and an average humidity is not lower than 30% and lower than 70%. The "LL environment" refers, for example, to an environment in which an average temperature is lower than 15° C. and an average humidity is lower than 30%.

As shown in FIG. 15, environment correction table 847 holds a higher correction coefficient as the temperature and the humidity are higher, and holds a lower correction coefficient as the temperature and the humidity are lower.

CPU 810 predicts at prescribed timing, a serviceable period of primary transfer roller 7 as being 330.5 k sheets in accordance with the method described above. CPU 810 further specifies a correction coefficient corresponding to an average environment at the prescribed timing by referring to average environment table 846 and environment correction table 847. By way of example, with the average temperature being 18° C. and the average humidity being 25%, CPU 810 specifies correction coefficient of 0.85 corresponding to the "NN-LL environment."

CPU 810 obtains corrected serviceable period of 280.9 k sheets by multiplying serviceable period of 330.5 k sheets of primary transfer roller 7 calculated with the method described above by specified correction coefficient of 0.85. CPU 810 according to the modification is configured to have the corrected serviceable period of primary transfer roller 7 shown on control panel 90.

According to the above, in prediction of a serviceable period of a member formed of the ion conductive material, image forming apparatus 600 according to the modification can predict a more accurate serviceable period by taking into account the average environment of the member.

In another aspect, image forming apparatus 600 may be configured to correct a serviceable period of a member formed of the ion conductive material based on an average environment during an immediately preceding prescribed period (for example, one month).

(Calculation of Serviceable Period by Server 800)

Though image forming apparatus 600 is configured to calculate a serviceable period of primary transfer roller 7 in the example above, in another aspect, server 800 may be configured to calculate a serviceable period of primary transfer roller 7.

In such a case, server 800 stores reference correspondence 841 in a not-shown storage. When prescribed timing comes (YES in step S1110 in FIG. 11), image forming apparatus 600 transmits to server 800, a resistance value of primary transfer roller 7 and a cumulative number of sheets printed by using primary transfer roller 7 based on a result of measurement with voltage sensor 720. Server 800 stores the received data in a resistance value history table in the not-shown storage.

A hardware processor (for example, a CPU) of server 800 predicts a serviceable period of primary transfer roller 7 by performing processing in steps S1130 to S1180 in FIG. 11 based on reference correspondence 841 and the resistance value history table stored in its storage. Server 800 transmits a result of prediction to image forming apparatus 600.

According to the above, image forming apparatus 600 itself does not have to perform processing for predicting a serviceable period of primary transfer roller 7. Server 800 can know a serviceable period of a member of connected image forming apparatus 600.

Second Embodiment

A configuration for predicting a serviceable period of a member in switching from the constant voltage mode to the constant current mode is described above. In a second embodiment, a configuration for predicting a serviceable period of a member in switching from the constant current mode to the constant voltage mode will be described.

(Structure of Image Forming Apparatus)

Figure 16:
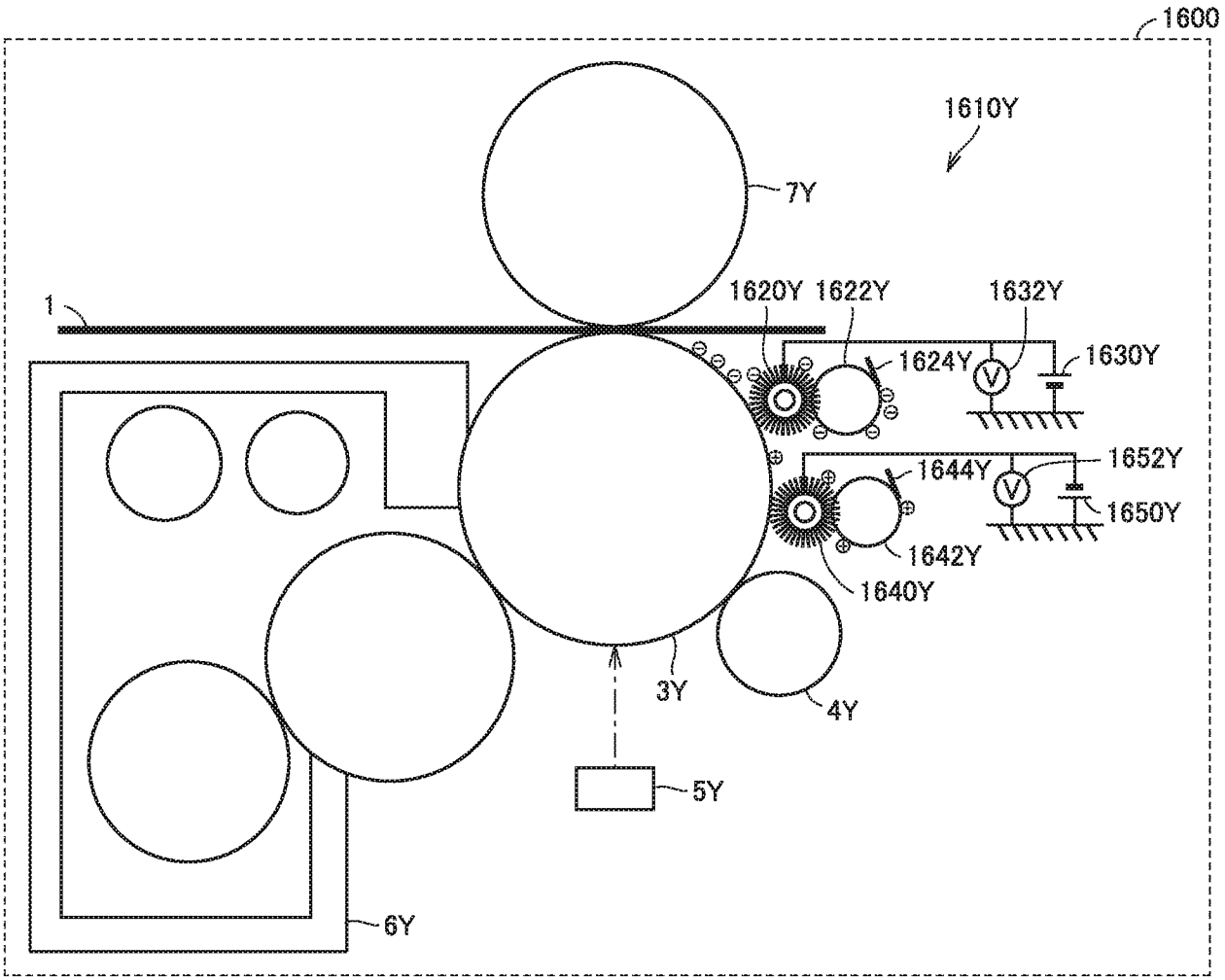
FIG. 16 is a diagram showing a structure of an imaging unit in an image forming apparatus according to a second embodiment.

FIG. 16 is a diagram showing a structure of an imaging unit 1610Y in an image forming apparatus 1600 according to the second embodiment. Image forming apparatus 1600 is different from image forming apparatus 600 according to the first embodiment in including imaging units 1610Y, 1610M, 1610C, and 1610K instead of imaging units 2Y, 2M, 2C, and 2K.

Since imaging units 1610Y, 1610M, 1610C, and 1610K are identical in construction, a construction of imaging unit 1610Y will be described below by way of example.

Referring to FIG. 16, imaging unit 1610Y further includes cleaning brushes 1620Y and 1640Y in addition to photoconductor 3Y, charging roller 4Y, exposure apparatus 5Y, development apparatus 6Y, and primary transfer roller 7Y.

A collection roller 1622Y is brought in pressure contact with cleaning brush 1620Y and a scraper 1624Y is arranged for collection roller 1622Y as abutting thereon. A power supply 1630Y positively charges cleaning brush 1620Y by applying a positive voltage to cleaning brush 1620Y.

A collection roller 1642Y is brought in pressure contact with cleaning brush 1640Y and a scraper 1644Y is arranged for collection roller 1642Y as abutting thereon. A power supply 1650Y negatively charges cleaning brush 1640Y by applying a negative voltage to cleaning brush 1640Y.

Power supplies 1630Y and 1650Y are configured to switch from the constant current mode to the constant voltage mode as cleaning brush 1620Y or 1640Y is used. Power supplies 1630Y and 1650Y feed a constant current to a corresponding cleaning brush in the constant current mode and apply a constant voltage to a corresponding cleaning brush in the constant voltage mode.

Toner which was not transferred by primary transfer roller 7Y (untransferred toner) is present on photoconductor 3Y. The untransferred toner is attracted and attached to cleaning brush 1620Y or 1640Y and collected to a not-shown box by scraper 1624Y or 1644Y with collection roller 1622Y or 1642Y being interposed.

Though the untransferred toner is basically negatively charged, some of toner is positively charged under the influence by a positive voltage applied by primary transfer roller 7Y. Therefore, positively charged cleaning brush 1620Y collects the negatively charged untransferred toner and negatively charged cleaning brush 1640Y collects positively charged untransferred toner.

Imaging unit 1610Y further includes a voltage sensor 1632Y for measuring an electrical characteristic value of cleaning brush 1620Y and a voltage sensor 1652Y for measuring an electrical characteristic value of cleaning brush 1640Y.

Though image forming apparatus 1600 is configured to include voltage sensors 1632Y and 1652Y in the example above, it may be configured to include only voltage sensor 1632Y when cleaning brushes 1620Y and 1640Y are simultaneously replaced as a unit.

The reason is because cleaning brush 1620Y is shorter in serviceable period than cleaning brush 1640Y. This is because most of the untransferred toner is negatively charged as described above and cleaning brush 1620Y collects more toner than cleaning brush 1640Y.

(Relation of Electrical Connection in Image Forming Apparatus)

Figure 17:
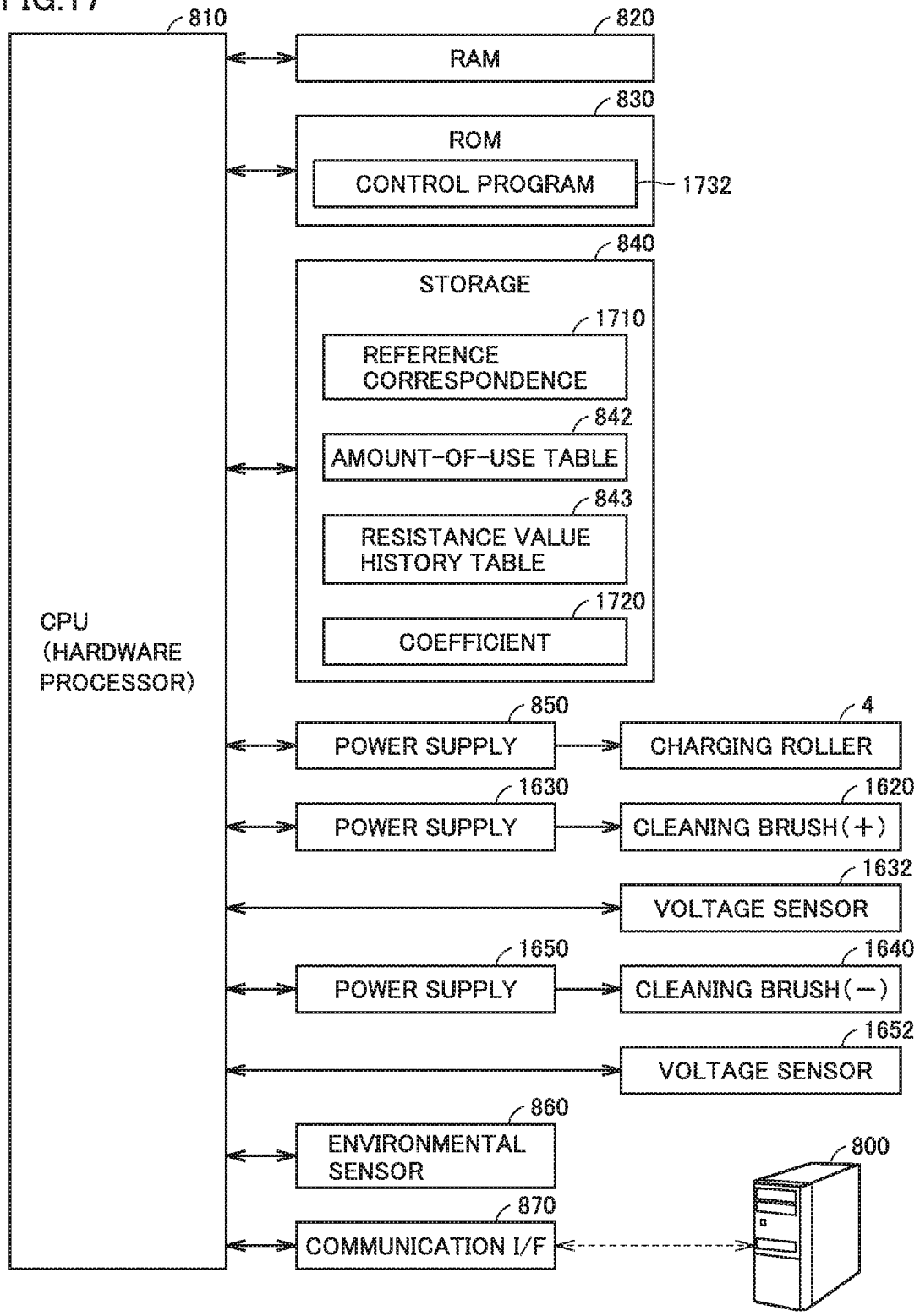
FIG. 17 is a diagram showing one example of an electrical configuration of the image forming apparatus according to the second embodiment.

FIG. 17 is a diagram showing one example of an electrical configuration of image forming apparatus 1600 according to the second embodiment. Elements shown in FIG. 17 the same as those shown in FIG. 8 have the same reference characters allotted and hence description thereof may not be repeated.

ROM 830 stores a control program 1732. Storage 840 stores reference correspondence 1710, amount-of-use table 842, resistance value history table 843, and a coefficient 1720.

Amount-of-use table 842 in the second embodiment stores an amount of use of cleaning brush 1620 of each color. The amount of use includes, for example, a cumulative number of printed sheets from start of use of cleaning brush 1620, the number of rotations of cleaning brush 1620, and a running distance. The amount of use for each color stored in amount-of-use table 842 is updated by CPU 810 each time cleaning brush 1620 is used.

Resistance value history table 843 in the second embodiment stores a history of resistance values of cleaning brush 1620 for each color. More specifically. CPU 810 calculates a resistance value of cleaning brush 1620 based on a result of measurement with voltage sensor 1632 obtained at prescribed timing. CPU 810 has the calculated resistance value and the cumulative number of sheets at the prescribed timing saved in resistance value history table 843 in association with each other.

Processing for predicting a serviceable period of cleaning brush 1620 with reference to reference correspondence 1710 and coefficient 1720 will be described below. A serviceable period of cleaning brush 1640 is predicted also by a similar method.

Figures 18A, 18B:
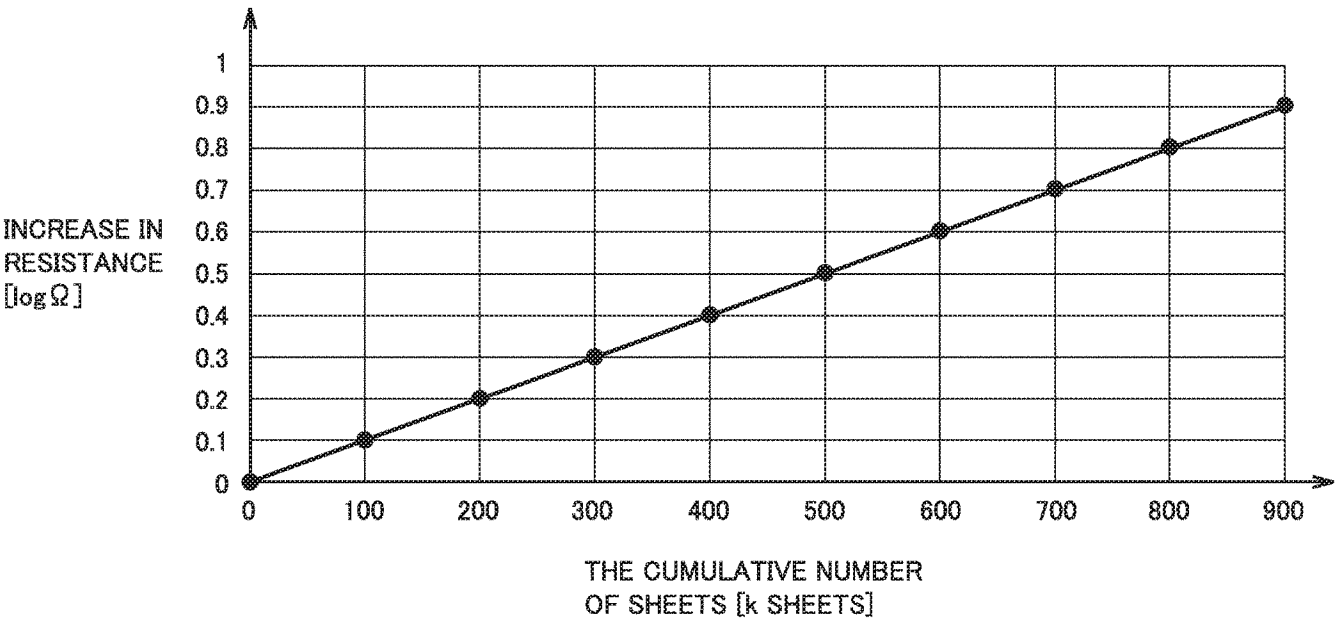
FIGS. 18A and 18B are diagrams for illustrating reference correspondence according to the second embodiment.

FIGS. 18A and 18B are diagrams for illustrating reference correspondence 1710. FIG. 18A shows one example of a data structure of reference correspondence 1710 according to one aspect. FIG. 18B is a diagram visually showing reference correspondence 1710.

Referring to FIG. 18A, reference correspondence 1710 holds relation between an amount of use of cleaning brush 1620 in the constant current mode and a reference rate of variation in resistance value of cleaning brush 1620. The amount of use of cleaning brush 1620 is divided into a plurality of successive sections. Each section holds one value of the reference rate of variation. Each reference rate of variation held in reference correspondence 1710 has a value calculated in advance through experiments under a predetermined condition. The predetermined condition includes predetermined temperature and humidity, a predetermined value of a current fed to cleaning brush 1620, and a predetermined number of printed sheets per print job.

Since the reference rate of variation is constant in the constant current mode as shown in FIG. 18B, one reference rate of variation (0.1 [log Ω/100 k sheets] in the example in FIG. 18B) may be stored without holding relation between the amount of use and the reference rate of variation as shown in FIG. 18A for each section.

Coefficient 1720 represents an inclination of a rate of variation in resistance value of cleaning brush 1620 with respect to an amount of use of cleaning brush 1620 in the constant voltage mode. For example, coefficient 1720 can be set to 0.8. This case means that, when a rate of variation between 600 k and 700 k sheets after switching to the constant voltage mode is 0.1 [log Ω/100 k sheets] by way of example, a subsequent rate of variation between 700 k and 800 k sheets is 0.08 (=0.1×0.08) [log Ω/100 k sheets] and a subsequent rate of variation between 800 k and 900 k sheets is 0.064 (=0.08×0.08). Coefficient 1720 is predetermined through experiments.

(Prediction of Lifetime of Cleaning Brush 1620)

Processing for predicting a serviceable period (a lifetime) of cleaning brush 1620 with reference to reference correspondence 1710 and coefficient 1720 will now be described with reference to a specific example.

Figure 19:
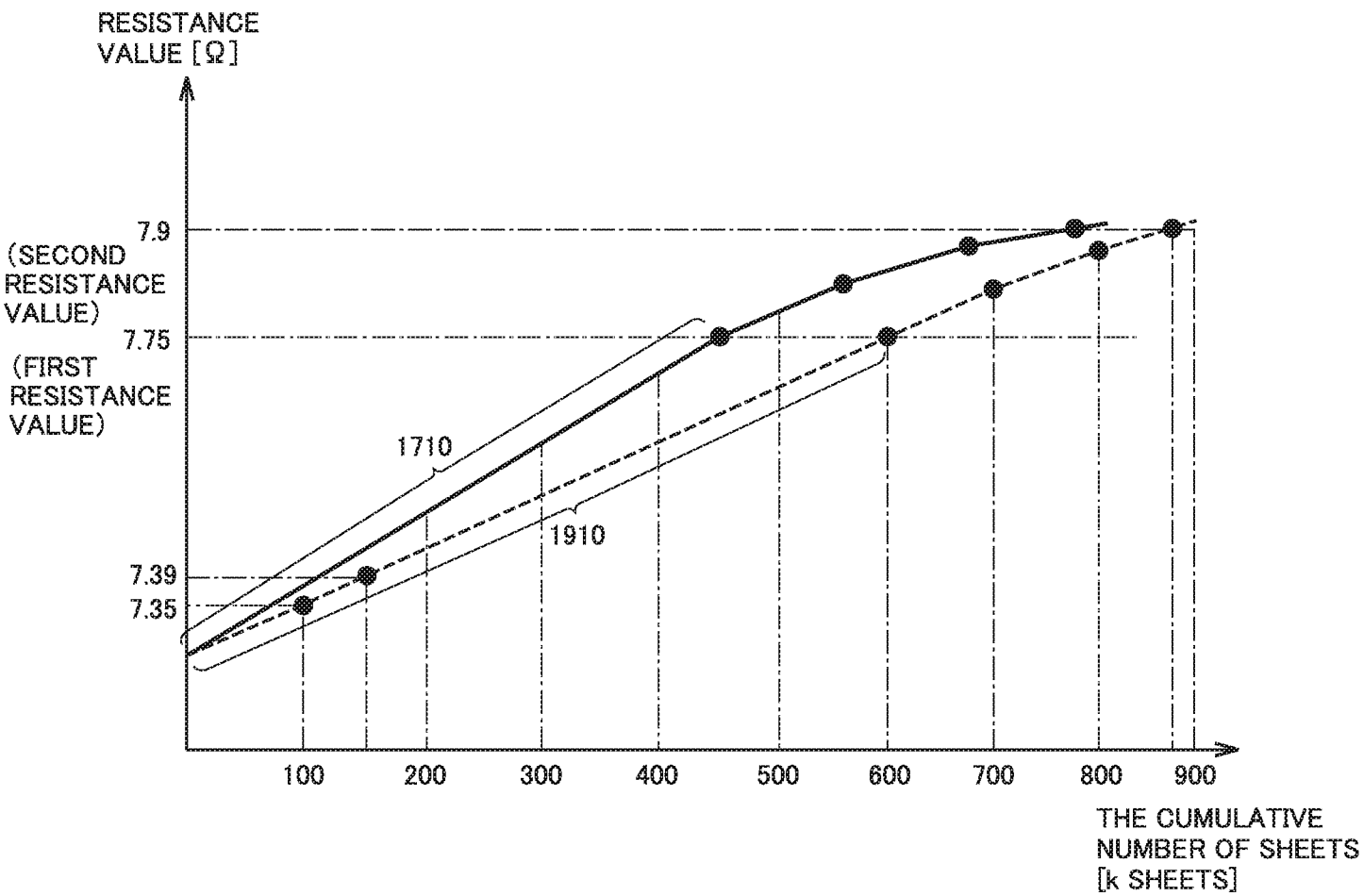
FIG. 19 is a diagram for illustrating processing for predicting a serviceable period of a cleaning brush.

FIG. 19 is a diagram for illustrating processing for predicting a serviceable period of cleaning brush 1620. The abscissa represents a cumulative number of printed sheets from start of use of cleaning brush 1620, and the ordinate represents a resistance value of cleaning brush 1620. By way of example, cleaning brush 1620 is assumed to have a resistance value of 7.35 log Ω when the cumulative number of sheets is 100 k and 7.39 log Ω when the cumulative number of sheets is 150 k. These values are calculated by CPU 810 based on a result of output from voltage sensor 1632. The first resistance value is assumed as 7.75 log Ω and the second resistance value is assumed as 7.9 log Ω.

Initially, CPU 810 calculates a rate of variation in resistance value of cleaning brush 1620 at the time when the cumulative number of sheets is from 100 k to 150 k as P1=(7.39−7.35)/(150−100)*100=0.08 [log Ω/100 k sheets].

By referring to reference correspondence 1710, CPU 810 specifies that reference rate of variation PA1 in resistance value at the time when the cumulative number of sheets is front 100 k to 150 k as 0.1 [log Ω/100 k sheets]. Reference rate of variation PA1 is a rate of variation estimated from reference correspondence 1710. In contrast, rate of variation P1 is an actual rate of variation calculated based on a result of measurement with voltage sensor 1632.

CPU 810 then calculates ratio RA of rate of variation P1 to reference rate of variation PA1. In the example above, ratio RA is calculated as ratio RA=0.08/0.1=0.8.

CPU 810 corrects each reference rate of variation held in reference correspondence 1710 by multiplying each reference rate of variation by ratio RA and calculates cumulative number of sheets N1 at the time of switching to the constant voltage mode based on corrected reference correspondence 1910 in accordance with an expression (6) below.

$$N1 = (\text{first resistance value} - R\ 150\ k)/\text{ratio } RA \times 100 + 150\ k \text{ sheets} \quad \text{<Expression 6>}$$
$$= (7.75 - 7.39)/0.08 \times 100 + 150\ k \text{ sheets}$$
$$= 600\ k \text{ sheets}$$

CPU 810 then calculates in accordance with an expression (7) below, a resistance value R 800 k of cleaning brush 1620 at the time point of 800 k sheets before reaching the second resistance value (7.9 log Ω).

$$R\ 800\ k = \text{rate of variation } P1 \times \text{coefficient } 1720 + \text{rate of variation } P1 \times \text{coefficient } 1720\text{^}2 + \text{first resistance value} \quad \text{<Expression 7>}$$
$$= 0.08 \times 0.8 + 0.08 \times 0.8\text{^}2 + 7.75$$
$$= 7.865$$

CPU 810 calculates a difference D2 between cumulative number of sheets 800 k sheets and cumulative number of sheets N2 in accordance with an expression (8) below.

$$D2 = (\text{second resistance value} - R\ 800\ k)/(\text{rate of variation } P1 \times \text{coefficient } 1720\text{^}3)*100 \quad \text{<Expression 8>}$$
$$= (7.9 - 7.865)/(0.08 \times 0.8\text{^}3)*100$$
$$= 85.4\ k \text{ sheets}$$

Based on the result above, CPU 810 calculates a serviceable period of cleaning brush 1620 as 885.4 k sheets.

(Control Structure)

Figure 20:
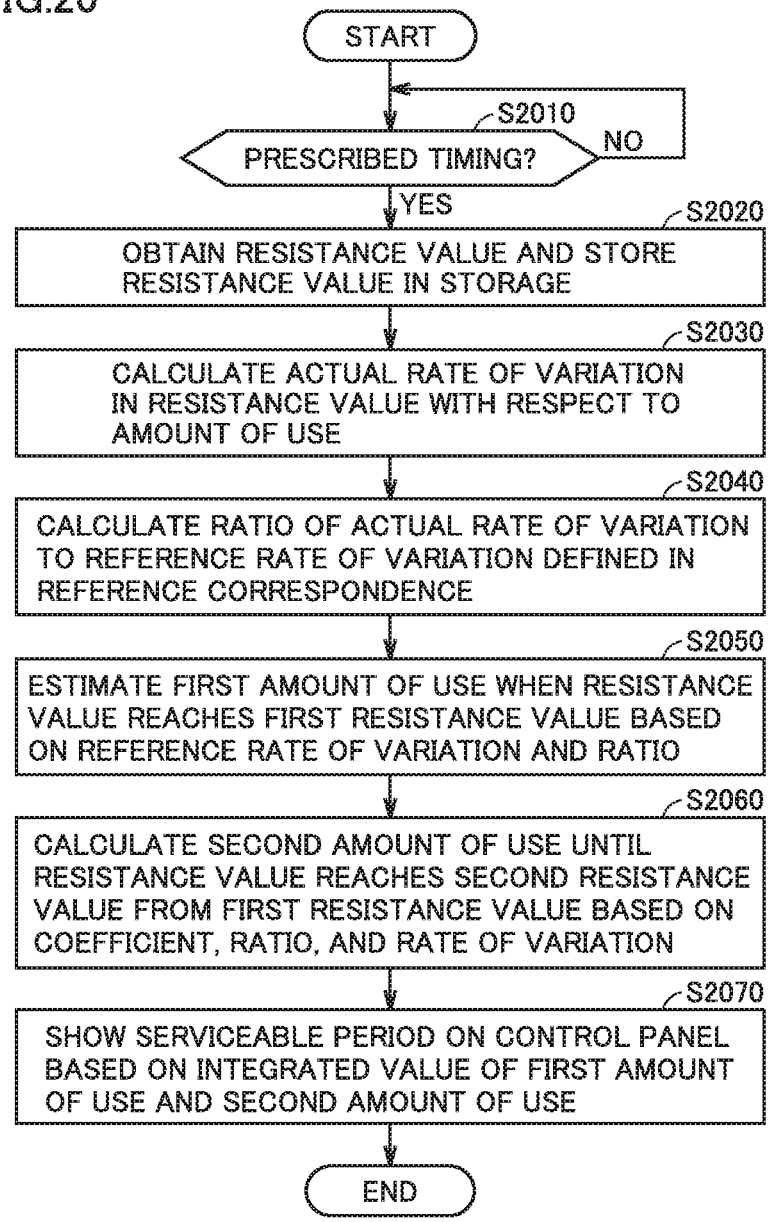
FIG. 20 is a flowchart showing processing for calculating a lifetime (a serviceable period) of the cleaning brush.

FIG. 20 is a flowchart showing a series of processing for calculating a lifetime (a serviceable period) of cleaning brush 1620. Each processing shown in FIG. 20 is performed by execution of control program 1732 by CPU 810.

In step S2010, CPU 810 determines whether or not prescribed timing has come. The prescribed timing includes, for example, timing of start of supply of power to image forming apparatus 1600, timing when the cumulative number of printed sheets from start of use of cleaning brush 1620 reaches a prescribed number of sheets (for example, every 50 k sheets), and timing designated and input by a user through control panel 90. CPU 810 performs processing in step S2020 when it determines that the prescribed timing has come.

In step S2020, CPU 810 measures with voltage sensor 1632, a value of a voltage generated in cleaning brush 1620 at the time when power supply 1630 applies a constant current (for example, 30 μA) to cleaning brush 1620. CPU 810 obtains a resistance value as an electrical characteristic value of cleaning brush 1620 based on a result of measurement. CPU 810 has the obtained resistance value and the cumulative number of sheets at the timing when it obtained the resistance value stored in resistance value history table 843 in association with each other.

In step S2030, CPU 810 calculates an actual rate of variation in resistance value with respect to an amount of use of cleaning brush 1620 by referring to resistance value history table 843.

In step S2040, CPU 810 calculates ratio RA of the calculated actual rate of variation to the reference rate of variation (=0.1 [log Ω/100 k sheets]) defined in reference correspondence 1710.

In step S2050, CPU 810 estimates cumulative number of printed sheets N1 (first amount of use) at the time when the resistance value of cleaning brush 1620 reaches the first resistance value based on (the reference rate of variation defined in) reference correspondence 1710 and ratio RA.

In step S2060, CPU 810 calculates the number of printed sheets (second amount of use) until the resistance value of cleaning brush 1620 reaches the second resistance value from the first resistance value based on the actual rate of variation, ratio RA, and coefficient 1720.

In step S2070, CPU 810 calculates the sum of the first amount of use and the second amount of use as cumulative number of sheets N2 (that is, a serviceable period of cleaning brush 1620). CPU 810 has the calculated serviceable period of cleaning brush 1620 shown on control panel 90.

According to the above, image forming apparatus 1600 according to the second embodiment can accurately predict the timing of switching between modes based on the actual rate of variation. Image forming apparatus 1600 corrects, based on ratio RA, a behavior of the resistance value of cleaning brush 1620 with respect to the amount of use of cleaning brush 1620 after switching from the constant current mode to the constant voltage mode. Thus, image forming apparatus 1600 can accurately predict a serviceable period of cleaning brush 1620 even though switching from the constant current mode to the constant voltage mode is made.

Though each processing described above is performed by a single CPU 810, limitation thereto is not intended. Various functions can be implemented by a semiconductor integrated circuit such as at least one processor, at least one application specific integrated circuit (ASIC), at least one digital signal processor (DSP), at least one field programmable gate array (FPGA), and/or other circuits with computation functions.

These circuits can perform various types of processing by reading at least one instruction from at least one tangible readable medium.

Though the medium is in a form of any type of a memory such as a magnetic medium (for example, a hard disk), an optical medium (for example, a compact disc (CD) or a DVD), a volatile memory, and a non-volatile memory, limitation thereto is not intended.

The volatile memory can include a dynamic random access memory (DRAM) and a static random access memory (SRAM). The non-volatile memory can include a ROM and an NVRAM.

[Additional Aspect]

Some of features of the present disclosure are summarized below.

According to one embodiment, an image forming apparatus including an image carrier for carrying a toner image, a member arranged in contact with or in proximity to the image carrier, a sensor for measuring an electrical characteristic value of the member, a power supply configured to be able to switch from a first mode in which one of a constant current and a constant voltage is applied to the member to a second mode in which the other of the constant current and the constant voltage is applied to the member as the member is used, a storage which stores first correspondence between an amount of use of the member in the first mode and the electrical characteristic value, and a hardware processor configured to predict a serviceable period of the member is provided. The hardware processor is configured to obtain second correspondence between the electrical characteristic value measured with the sensor and the amount of use of the member in the first mode and to predict a serviceable period of the member when the power supply is switched to the second mode based on the first correspondence and the second correspondence.

Preferably, the power supply is configured to be able to switch front the first mode to the second mode based on the electrical characteristic value reaching a first value. The hardware processor is configured to predict a period until the electrical characteristic value reaches a second value greater than the first value based on the first correspondence and the second correspondence.

Preferably, the first correspondence holds relation between the amount of use of the member in the first mode and a rate of variation in electrical characteristic value. The second correspondence includes a rate of variation in the electrical characteristic value measured with the sensor with respect to the amount of use of the member in the first mode.

Further preferably, the hardware processor is configured to obtain a rate of variation as the second correspondence based on a difference in electrical characteristic value measured at different timing with the sensor and a difference in amount of use at the different timing.

Preferably, the hardware processor is configured to calculate a ratio between the rate of variation calculated as the second correspondence and the rate of variation determined by the first correspondence and to predict the serviceable period based on the ratio.

Preferably, when a constant voltage is applied to the member in the first mode, the rate of variation in electrical characteristic value in the first correspondence is defined to vary like a logarithmic function with respect to the amount of use of the member. When a constant current is fed to the member in the first mode, the rate of variation in electrical characteristic value in the first correspondence is defined to vary in proportion to the amount of use of the member.

Preferably, the electrical characteristic value of the member includes a resistance value of the member.

Preferably, the sensor is configured to obtain a value of a voltage generated in the member when a constant current is fed to the member at prescribed timing or a value of a current which flows to the member when a constant voltage is applied to the member at the prescribed timing.

Preferably, the image forming apparatus further includes an environmental sensor which measures a temperature and a humidity. The hardware processor is configured to correct a result of prediction of the serviceable period of the member based on a result of measurement with the environmental sensor.

Further preferably, the hardware processor is configured to correct the result of prediction of the serviceable period to be longer as the temperature or the humidity is higher and to correct the result of prediction of the serviceable period to be shorter as the temperature or the humidity is lower.

Preferably, the hardware processor is configured to correct a result of prediction of the serviceable period of the member based on an average number of printed sheets per one print job.

Further preferably, the hardware processor is configured to correct the result of prediction of the serviceable period to be shorter as the average number of printed sheets per one print job is greater and to correct the result of prediction of the serviceable period to be longer as the average number of printed sheets per one print job is smaller.

Preferably, the member includes a primary transfer roller for transferring the toner image formed on the image carrier.

Further preferably, the power supply is configured to switch from the first mode in which a constant voltage is applied to the primary transfer roller to the second mode in which a constant current is applied to the primary transfer roller.

Preferably, the member includes a cleaning brush for collecting toner which remains on the image carrier.

Further preferably, the power supply is configured to switch from the first mode in which a constant current is applied to the cleaning brush to the second mode in which a constant voltage is applied to the cleaning brush.

Preferably, the member includes a charging roller for charging the image carrier.

According to another aspect, a non-transitory computer-readable recording medium having a program stored thereon, the program being executed by a computer for predicting a serviceable period of a member arranged in contact with or in proximity to an image carrier included in an image forming apparatus, is provided. The image forming apparatus includes a sensor for measuring an electrical characteristic value of the member and a power supply configured to be able to switch from a first mode in which one of a constant current and a constant voltage is applied to the member to a second mode in which the other of the constant current and the constant voltage is applied to the member as the member is used. The program causes the computer to perform obtaining first correspondence between the electrical characteristic value measured with the sensor and an amount of use of the member in the first mode and predicting a serviceable period of the member when the power supply is switched to the second mode based on second correspondence between the amount of use of the member in the first mode and the electrical characteristic value stored in a storage and the obtained first correspondence.

According to yet another aspect, a server capable of communicating with an image forming apparatus is provided. The image forming apparatus includes an image carrier for carrying a toner image, a member arranged in contact with or in proximity to the image carrier, a sensor for measuring an electrical characteristic value of the member, and a power supply configured to be able to switch from a first mode in which one of a constant current and a constant voltage is applied to the member to a second mode in which the other of the constant current and the constant voltage is applied to the member as the member is used. The server includes a storage which stores first correspondence between an amount of use of the member in the first mode and the electrical characteristic value and a hardware processor configured to predict a serviceable period of the member. The hardware processor is configured to receive the electrical characteristic value measured with the sensor and the amount of use of the member in the first mode, obtain second correspondence between the received electrical characteristic value and the amount of use, predict a serviceable period of the member when the power supply is switched to the second mode based on the first correspondence and the second correspondence, and transmit a result of prediction to the image forming apparatus.

Although embodiments of the present invention have been described and illustrated in detail, the disclosed embodiments are made for the purposes of illustration and example only and not limitation. The scope of the present invention should be interpreted by terms of the appended claims.

What is claimed is:

1. An image forming apparatus comprising:

an image carrier for carrying a toner image;

a member arranged in contact with or in proximity to the image carrier;

a sensor for measuring an electrical characteristic value of the member;

a power supply configured to be able to switch from a first mode in which one of a constant current and a constant voltage is applied to the member to a second mode in which the other of the constant current and the constant voltage is applied to the member as the member is used;

a storage which stores first correspondence between an amount of use of the member in the first mode and the electrical characteristic value; and a hardware processor configured to predict a serviceable period of the member, the hardware processor being configured to:

obtain second correspondence between the electrical characteristic value measured with the sensor and the amount of use of the member in the first mode; and predict a serviceable period of the member when the power supply is switched to the second mode based on the first correspondence and the second correspondence.

2. The image forming apparatus according to claim 1, wherein the power supply is configured to be able to switch front the first mode to the second mode based on the electrical characteristic value reaching a first value, and the hardware processor is configured to predict a period until the electrical characteristic value reaches a second value greater than the first value based on the first correspondence and the second correspondence.

3. The image forming apparatus according to claim 1, wherein the first correspondence holds relation between the amount of use of the member in the first mode and a rate of variation in the electrical characteristic value, and the second correspondence includes a rate of variation in the electrical characteristic value measured with the sensor with respect to the amount of use of the member in the first mode.

4. The image forming apparatus according to claim 3, wherein the hardware processor is configured to obtain the rate of variation as the second correspondence based on a difference in the electrical characteristic value measured at different timing with the sensor and a difference in amount of use at the different timing.

5. The image forming apparatus according to claim 3, wherein the hardware processor is configured to calculate a ratio between the rate of variation calculated as the second correspondence and the rate of variation determined by the first correspondence and to predict the serviceable period based on the ratio.

6. The image forming apparatus according to claim 3, wherein when a constant voltage is applied to the member in the first mode, the rate of variation in the electrical characteristic value in the first correspondence is defined to vary like a logarithmic function with respect to the amount of use of the member, and when a constant current is fed to the member in the first mode, the rate of variation in the electrical characteristic value in the first correspondence is defined to vary in proportion to the amount of use of the member.

7. The image forming apparatus according to claim 1, wherein the electrical characteristic value of the member includes a resistance value of the member.

8. The image forming apparatus according to claim 1, wherein the sensor is configured to obtain a value of a voltage generated in the member when a constant current is fed to the member at prescribed timing or a value of a current which flows to the member when a constant voltage is applied to the member at the prescribed timing.

9. The image forming apparatus according to claim 1, the image forming apparatus further comprising an environmental sensor which measures a temperature and a humidity, wherein the hardware processor is configured to correct a result of prediction of the serviceable period of the member based on a result of measurement with the environmental sensor.

10. The image forming apparatus according to claim 9, wherein the hardware processor is configured to correct the result of prediction of the serviceable period to be longer as the temperature or the humidity is higher and to correct the result of prediction of the serviceable period to be shorter as the temperature or the humidity is lower.

11. The image forming apparatus according to claim 1, wherein the hardware processor is configured to correct a result of prediction of the serviceable period of the member based on an average number of printed sheets per one print job.

12. The image forming apparatus according to claim 11, wherein the hardware processor is configured to correct the result of prediction of the serviceable period to be shorter as the average number of printed sheets per one print job is greater and to correct the result of prediction of the serviceable period to be longer as the average number of printed sheets per one print job is smaller.

13. The image forming apparatus according to claim 1, wherein the member includes a primary transfer roller for transferring the toner image formed on the image carrier.

14. The image forming apparatus according to claim 13, wherein the power supply is configured to switch from the first mode in which a constant voltage is applied to the primary transfer roller to the second mode in which a constant current is applied to the primary transfer roller.

15. The image forming apparatus according to claim 1, wherein the member includes a cleaning brush for collecting toner which remains on the image carrier.

16. The image forming apparatus according to claim 15, wherein the power supply is configured to switch from the first mode in which a constant current is applied to the cleaning brush to the second mode in which a constant voltage is applied to the cleaning brush.

17. The image forming apparatus according to claim 1, wherein the member includes a charging roller for charging the image carrier.

18. A non-transitory computer-readable recording medium having a program stored thereon, the program being executed by a computer for predicting a serviceable period of a member arranged in contact with or in proximity to an image carrier included in an image forming apparatus, the image forming apparatus including a sensor for measuring an electrical characteristic value of the member and a power supply configured to be able to switch from a first mode in which one of a constant current and a constant voltage is applied to the member to a second mode in which the other of the constant current and the constant voltage is applied to the member as the member is used, the program causing the computer to perform:

obtaining first correspondence between the electrical characteristic value measured with the sensor and an amount of use of the member in the first mode; and predicting a serviceable period of the member when the power supply is switched to the second mode based on second correspondence between the amount of use of the member in the first mode and the electrical characteristic value stored in a storage and the obtained first correspondence.

19. A server capable of communicating with an image forming apparatus, the image forming apparatus including an image carrier for carrying a toner image, a member arranged in contact with or in proximity to the image carrier, a sensor for measuring an electrical characteristic value of the member, and a power supply configured to be able to switch from a first mode in which one of a constant current and a constant voltage is applied to the member to a second mode in which the other of the constant current and the constant voltage is applied to the member as the member is used, the server comprising:

a storage which stores first correspondence between an amount of use of the member in the first mode and the electrical characteristic value; and a hardware processor configured to predict a serviceable period of the member, the hardware processor being configured to:

receive the electrical characteristic value measured with the sensor and the amount of use of the member in the first mode from the image forming apparatus;

obtain second correspondence between the received electrical characteristic value and the amount of use;

predict a serviceable period of the member when the power supply is switched to the second mode based on the first correspondence and the second correspondence; and transmit a result of prediction to the image forming apparatus.

* * * * *